US007837265B2

(12) United States Patent
Machael et al.

(10) Patent No.: US 7,837,265 B2
(45) Date of Patent: Nov. 23, 2010

(54) RECLINING CHAIR WITH ENHANCED ADJUSTABILITY

(75) Inventors: Jay R. Machael, Muscatine, IA (US); John R. Koch, Muscatine, IA (US); Marcus C. Koepke, Indianapolis, IN (US)

(73) Assignee: HNI Corporation, Muscatine, IA (US)

( * ) Notice: Subject to any disclaimer, the term of this patent is extended or adjusted under 35 U.S.C. 154(b) by 379 days.

(21) Appl. No.: 11/388,331

(22) Filed: Mar. 24, 2006

(65) Prior Publication Data

US 2007/0222265 A1 Sep. 27, 2007

(51) Int. Cl.
*A47C 1/24* (2006.01)
*A47C 1/32* (2006.01)

(52) U.S. Cl. ..... 297/300.2; 297/300.6; 297/303.1

(58) Field of Classification Search ... 297/300.5–300.6, 297/300.2, 303.4, 354.11, 300.1, 303.1
See application file for complete search history.

(56) References Cited

U.S. PATENT DOCUMENTS

| | | | | |
|---|---|---|---|---|
| 186,462 | A | 1/1877 | Clay | |
| 909,751 | A | 1/1909 | Butcher et al. | |
| 1,290,532 | A | 1/1919 | Fischer | |
| 2,312,030 | A | 2/1943 | Cramer et al. | |
| 2,796,920 | A | 6/1957 | Cowles | |
| 3,453,024 | A | 7/1969 | Williams | |
| 4,014,507 | A | 3/1977 | Swenson | |
| 4,168,050 | A | 9/1979 | Nerem et al. | |
| 4,429,917 | A * | 2/1984 | Diffrient | 297/300.5 |
| 4,653,806 | A | 3/1987 | Willi | |
| 5,649,740 | A * | 7/1997 | Hodgdon | 297/303.1 |
| 5,756,488 | A | 5/1998 | Beda et al. | |
| 5,772,282 | A | 6/1998 | Stumpf et al. | |
| 5,797,652 | A | 8/1998 | Darbyshire | |

(Continued)

FOREIGN PATENT DOCUMENTS

| | | |
|---|---|---|
| DE | 3640336 | 8/1987 |

(Continued)

OTHER PUBLICATIONS

International search report for international application No. PCT/US2007/064413 mailed Aug. 8, 2007.

(Continued)

*Primary Examiner*—David Dunn
*Assistant Examiner*—Tania Abraham
(74) *Attorney, Agent, or Firm*—Faegre & Benson LLP

(57) ABSTRACT

An adjustable reclining chair including a seat configured to support a user, a chair back, a base and a control mechanism mounted on the base. The control mechanism coupling the chair back to the seat with the chair back located generally adjacent to the user's back when the user is seated upon the seat. The control mechanism including a resistance adjustment mechanism for varying the control mechanism's resistance to a reclining force applied by the user to the chair back in order to move the chair back rearward from an upright position. The resistance adjustment mechanism activated by the weight of the user when seated in the chair, such that easy adjustment of the resistance is facilitated with the chair in an upright position. The resistance adjustment mechanism including a resilient member placed under a load during reclining of the chair to provide resistance to the reclining force.

10 Claims, 36 Drawing Sheets

U.S. PATENT DOCUMENTS

| | | | | |
|---|---|---|---|---|
| 6,035,901 | A | 3/2000 | Stumpf et al. | |
| 6,176,548 | B1 * | 1/2001 | Thole et al. | 297/302.1 |
| 6,523,898 | B1 | 2/2003 | Ball et al. | |
| 6,572,190 | B2 | 6/2003 | Koepke et al. | |
| 6,588,842 | B2 | 7/2003 | Stumpf et al. | |
| 6,609,755 | B2 | 8/2003 | Koepke et al. | |
| 6,616,231 | B2 | 9/2003 | Koepke et al. | |
| 6,669,292 | B2 * | 12/2003 | Koepke et al. | 297/300.2 |
| 6,688,692 | B2 | 2/2004 | Phillips et al. | |
| 6,709,058 | B1 * | 3/2004 | Diffrient | 297/320 |
| 6,722,741 | B2 | 4/2004 | Stumpf et al. | |
| 6,729,691 | B2 | 5/2004 | Koepke et al. | |
| 6,935,689 | B2 | 8/2005 | Horiki et al. | |
| 6,959,965 | B2 | 11/2005 | Diffrient | |
| 6,966,604 | B2 | 11/2005 | Stumpf et al. | |
| 6,981,743 | B2 | 1/2006 | Edwards et al. | |
| 6,991,291 | B2 | 1/2006 | Knoblock et al. | |
| 6,994,400 | B2 | 2/2006 | Koepke et al. | |
| 7,273,253 | B2 * | 9/2007 | Deimen et al. | 297/300.4 |
| 7,281,764 | B2 * | 10/2007 | Thole | 297/303.4 |
| 2002/0043843 | A1 | 4/2002 | Pennington et al. | |
| 2004/0017102 | A1 | 1/2004 | Igarashi et al. | |

FOREIGN PATENT DOCUMENTS

| | | |
|---|---|---|
| DE | 29507658 | 2/1996 |
| DE | 4437394 | 4/1996 |
| DE | 29711329 | 8/1997 |
| EP | 0574375 | 12/1993 |
| EP | 0688522 | 12/1995 |
| EP | 0970639 | 1/2000 |
| JP | 2004/049658 | 2/2004 |
| JP | 2004/049691 | 2/2004 |
| WO | WO 2004/008915 | 1/2004 |
| WO | 2007112236 | 10/2007 |

OTHER PUBLICATIONS

Product information, TEKNION, "Contessa Task," http://www.teknion.com/products/seating_contessa/default.asp?country=pacific, 2 pp. © 2003-2004.

Printout from website, Okamura Corporation, "Contessa-Ergonomic concept" http://www.okamura.co.jp/english/product/office/concept/index.html, 2 pp. © 2000-2004.

* cited by examiner

RECLINING CHAIR WITH ENHANCED ADJUSTABILITY

FIELD OF THE INVENTION

This invention relates to ergonomic seating, in particular, adjustable, reclining chairs.

BACKGROUND OF THE INVENTION

Ergonomically designed office chairs are commonly configured so that the back can recline alone, the seat and back can recline as a unit, or the back can recline in a coordinated proportion with the seat. The latter are commonly known as "synchro-tilt" chairs. Most of these synchro-tilt chairs have a mechanism that loads a spring as the user reclines and a mechanism for adjusting the resistance to being reclined (also known as tilt or chair tension). In these chairs, the pre-load on the spring requires the user to input a high force or a large displacement in order to make any adjustments to the chair tilt tension. These adjustments often are difficult, awkward or require an extensive amount of user work to generate perceptible changes in the tension. In addition, most of these chairs provide no visual or tactile feedback to the user about the range of tension adjustment available and where, within this range, the chair is currently. As a result, many users don't take full advantage of the versatility of the chair in accommodating their comfort. For example, many of these chairs provide a rotatable knob or handle underneath the seat that includes plus and minus symbols. Rotation of this knob can require 30 revolutions or more to adjust the tension between the lowest and highest available levels.

The force applied to the chair back during reclining, as mentioned above, also may result in a shearing force between the user's back and the chair back. This shearing force may be perceived by the user as a tendency for the chair back to pull out the user's shirt tail, known as 'shirt pull' in the industry. In addition, reclining in these types of chairs may also cause a "pull-away" between the chair back and the user's back, such that the chair back does not remain in contact with the user's back as the chair reclines. As a result, the chair fails to provide proper support causing discomfort and dissatisfaction.

In addition to adjustment of the tilt tension, many of these chairs include a tilt lock to prohibit reclining of the chair, a seat height adjustment, arm adjustments, and/or seat position adjustments. Improvements in these other chair adjustments are also desirable to make them more user friendly and thereby encourage the user to take advantage of the various adjustments available to customize the chair for the user's personal comfort or work style.

SUMMARY OF THE INVENTION

The present invention overcomes the short comings of the prior art by providing an adjustable reclining chair including a seat configured to support a user, a chair back, a base and a control mechanism mounted on the base. The control mechanism couples the chair back to the seat with the chair back located generally adjacent to the user's back when the user is seated upon the seat. The control mechanism includes a resistance adjustment mechanism for varying the control mechanism's resistance to a reclining force applied by the user to the chair back in order to move the chair back rearward from an upright position. The resistance adjustment mechanism is activated by the weight of the user when seated in the chair, such that easy adjustment of the resistance is facilitated with the chair in an upright position.

The present invention also provides an adjustable reclining chair including a chair back, a seat, a base having a central axis and a control mechanism mounted on the base, the control mechanism coupling the chair back to the seat. The control mechanism is configured as a four-bar mechanism including a ground member and a pivot member pivotally coupled to the ground member at a pivot point forward of the central axis, the pivot member pivotally attached to the chair back at a back pivot. A reclining force applied by the user to the chair back results in the chair back moving rearward, pivoting the pivot member relative to the ground member about the pivot point and the chair back about the back pivot, with the chair back remaining generally in contact with the user's back due to reduced shear and pull-away forces.

The present invention also provides an adjustable chair back including a back frame, a resilient material attached to the back frame, the resilient material held in tension across the chair back and an adjustment mechanism coupled to the frame and engaging the resilient material. The adjustment mechanism is configured to modify a stiffness of the resilient material of the chair back.

DETAILED DESCRIPTION OF THE INVENTION

With reference to the attached Figures, it is to be understood that like components are labeled with like numerals throughout the several Figures. Unless otherwise specified, the components described herein with respect to the present invention may be formed from any suitable material and by any suitable manufacturing method. For example, parts may be formed from plastic, such as glass-filled nylon or other moldable materials, or from die-cast aluminum.

Figure 1:
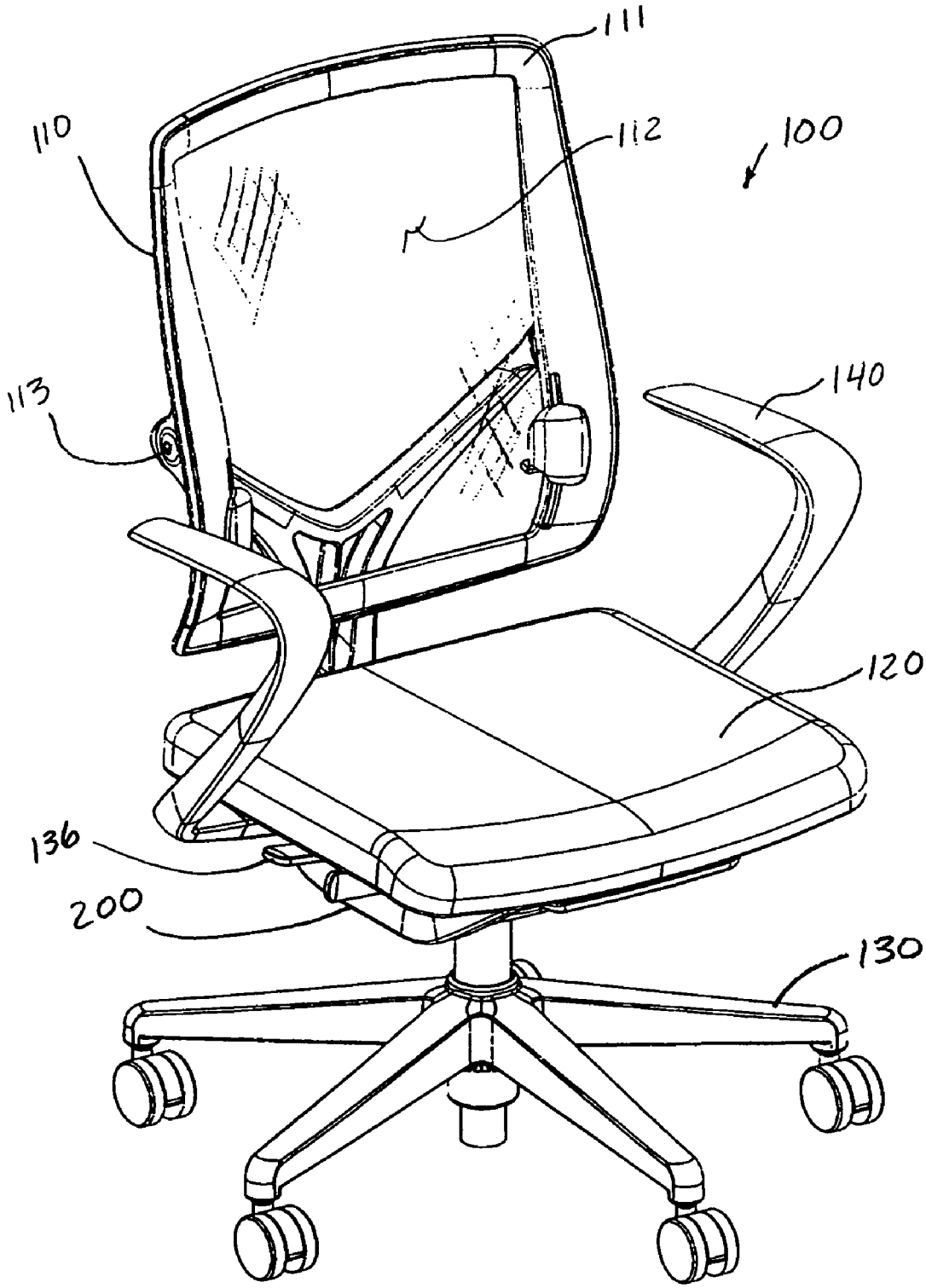
FIG. 1 is a perspective view of a chair in an upright position in accordance with the present invention, including a mesh back and fixed arms.
Figure 2:
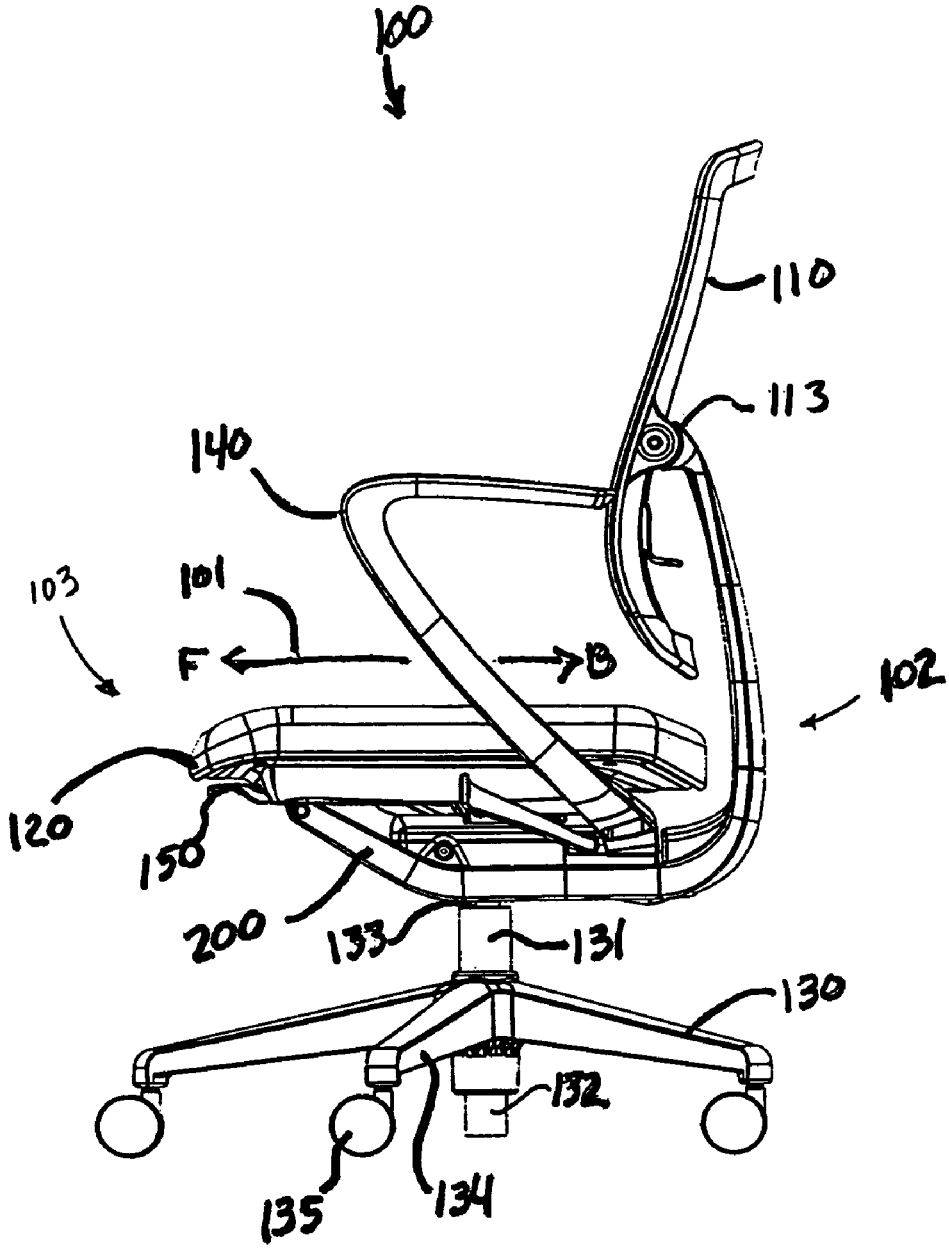
FIG. 2 is a right side view of the chair of FIG. 1.
Figure 3:
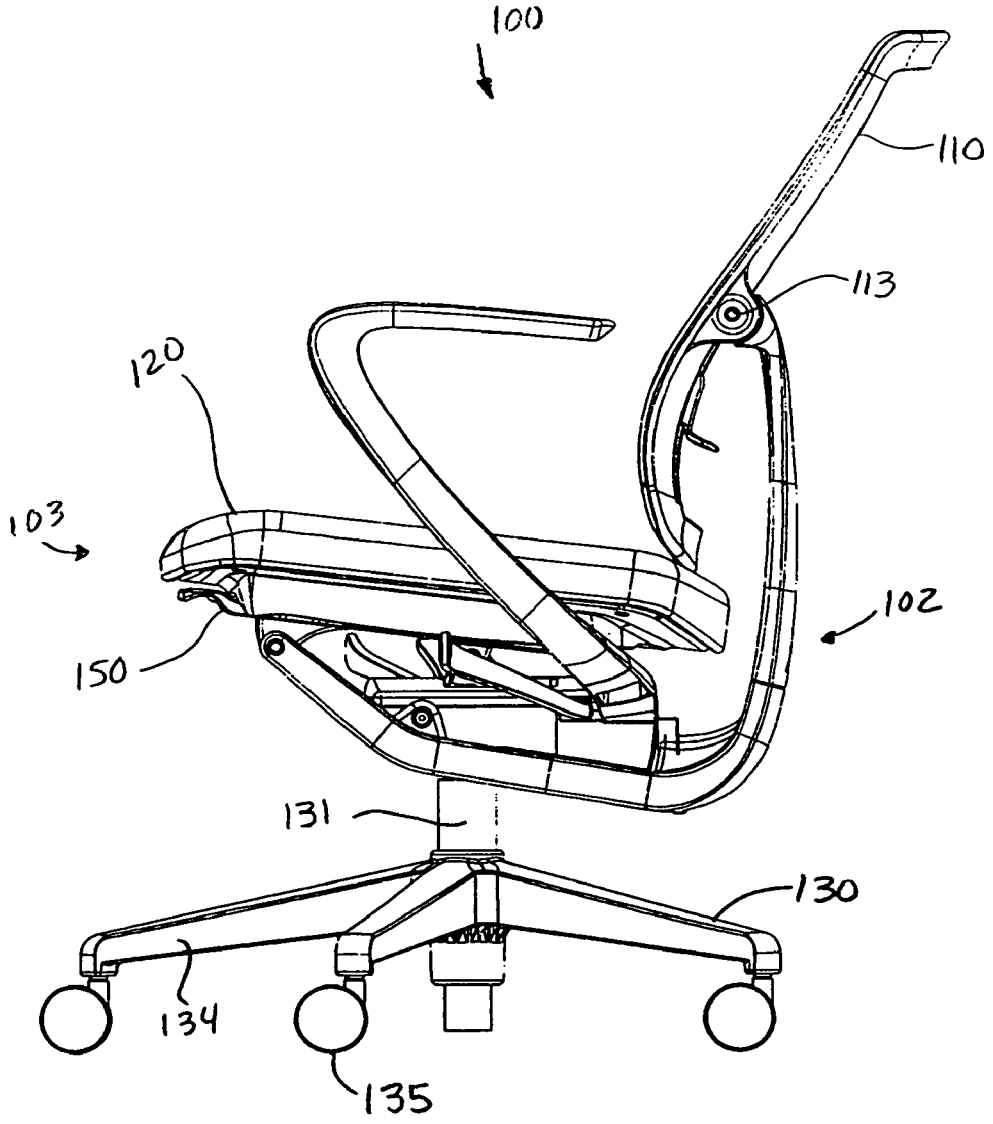
FIG. 3 is a right side view of the chair of FIG. 1 shown in a reclined position.
Figure 4:
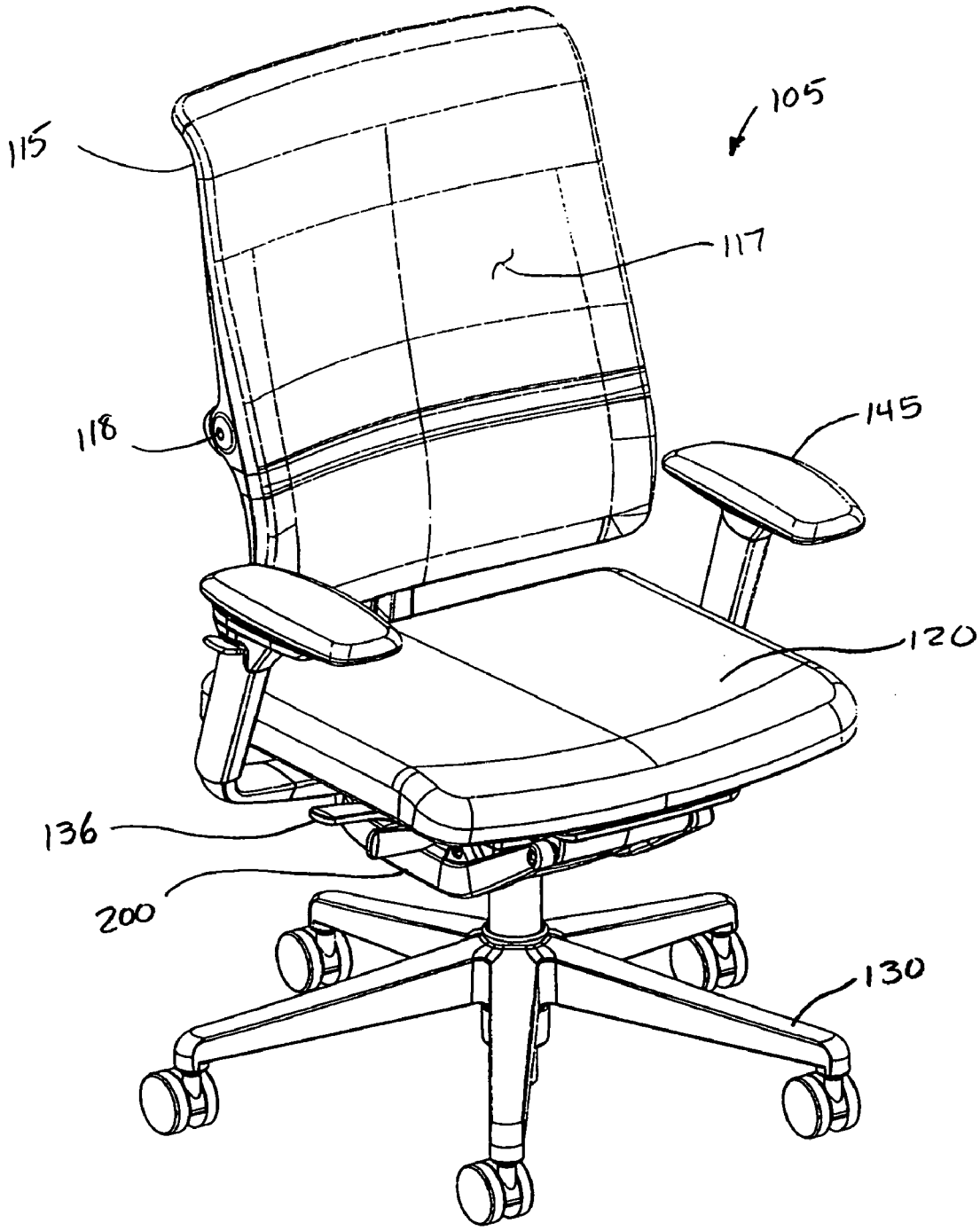
FIG. 4 is a perspective view of a chair in an upright position in accordance with the present invention, including an upholstered back and adjustable arms.
Figure 5:
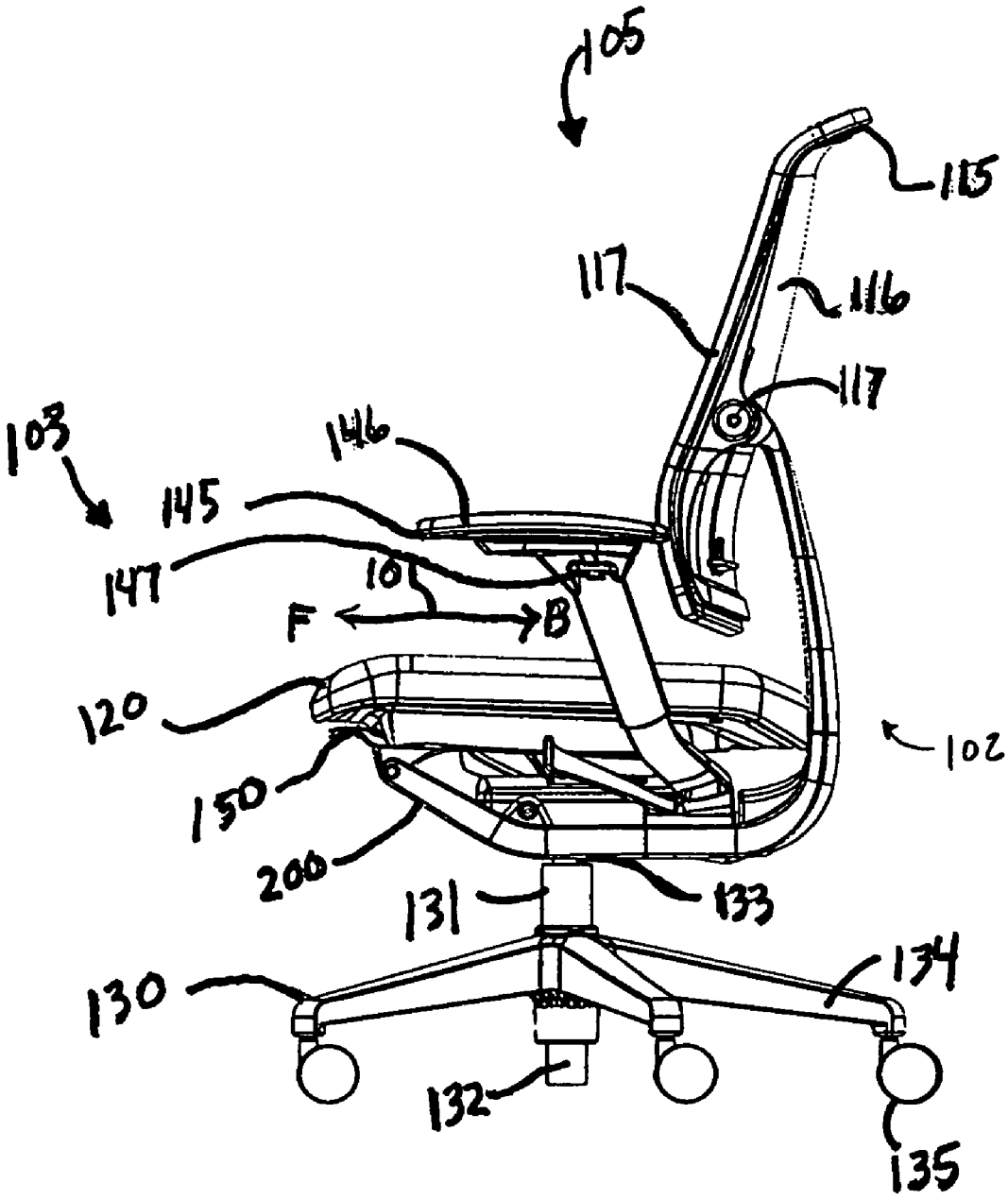
FIG. 5 is a right side view of the chair of FIG. 4.
Figure 6:
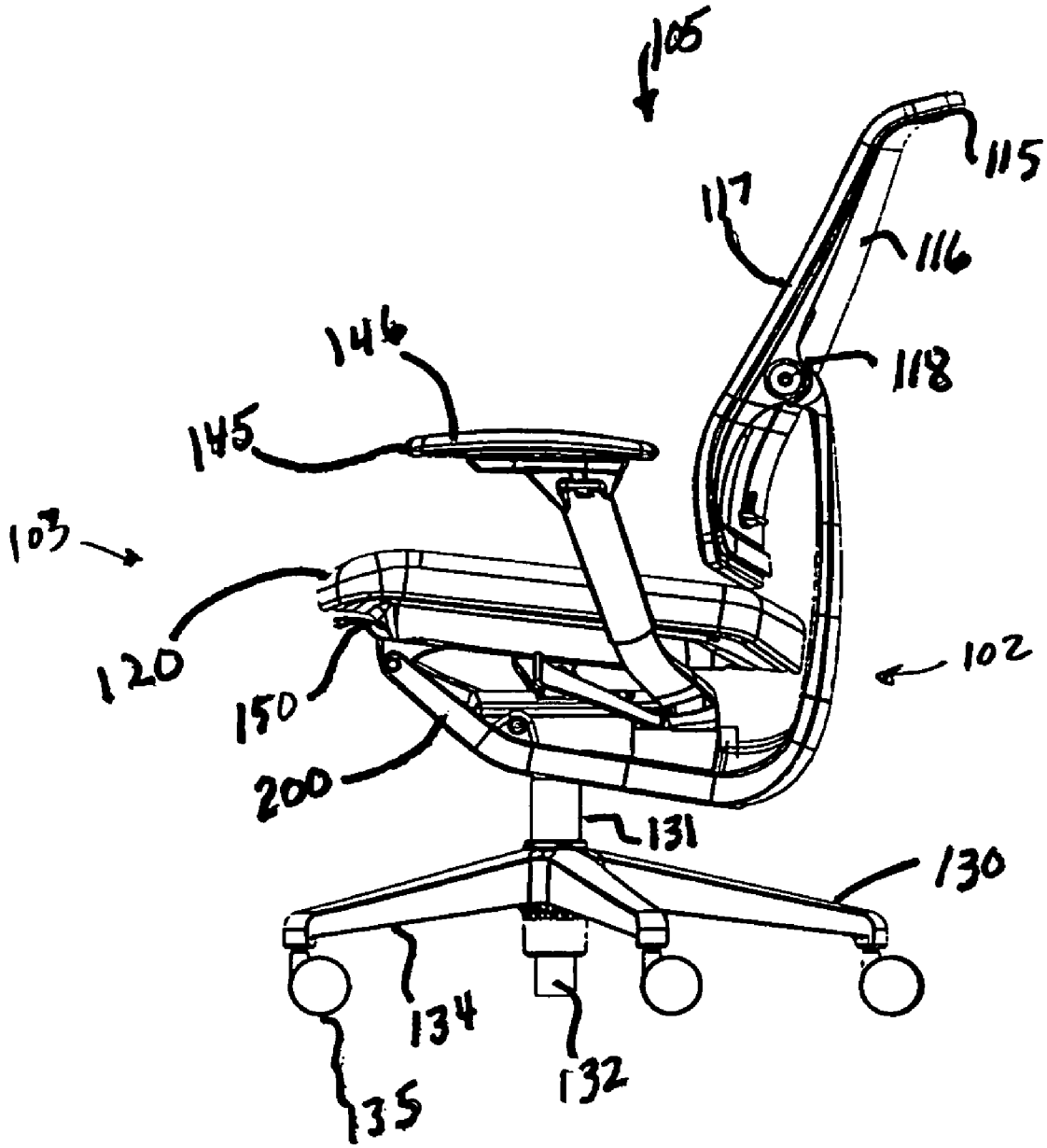
FIG. 6 is a right side view of the chair of FIG. 4 shown in a reclined position.
Figure 7:
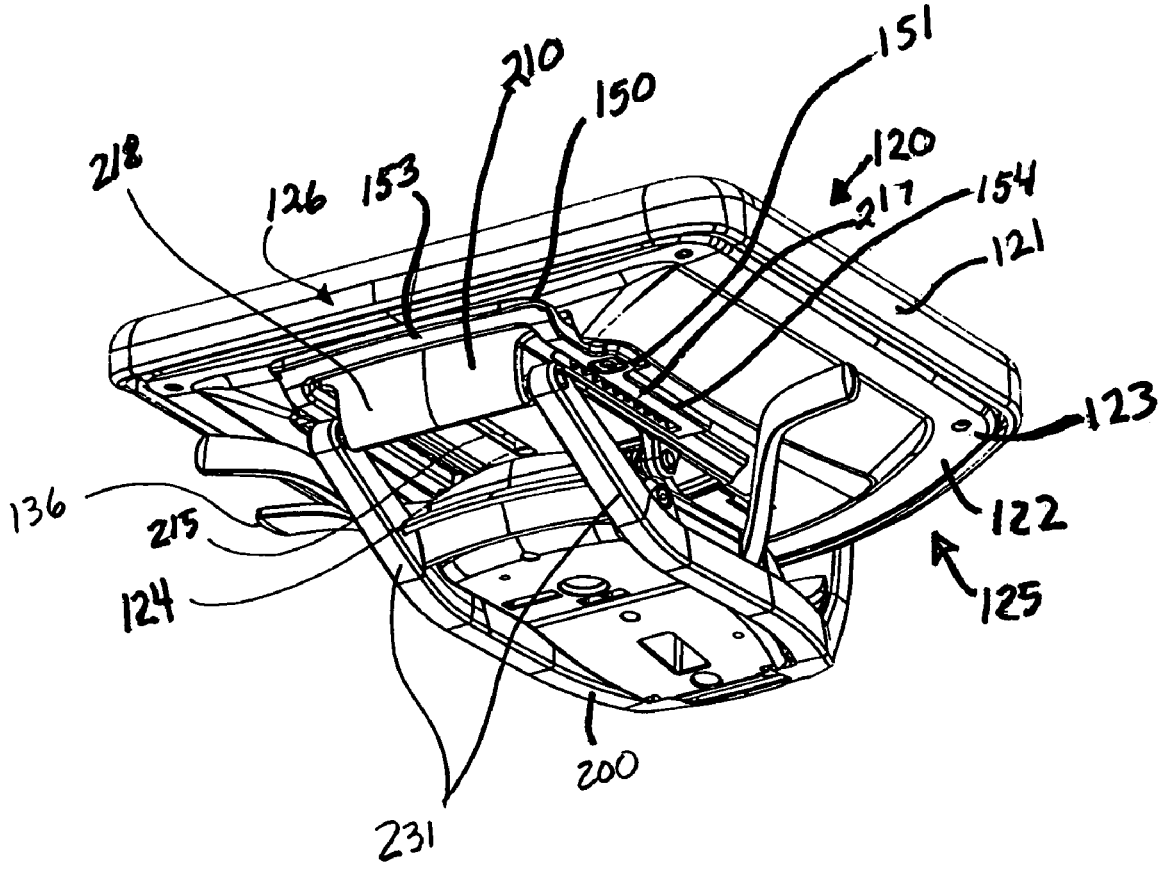
FIG. 7 is a perspective partial view of the seat structure of the chair of FIG. 1 viewed from the front underside.
Figure 8:
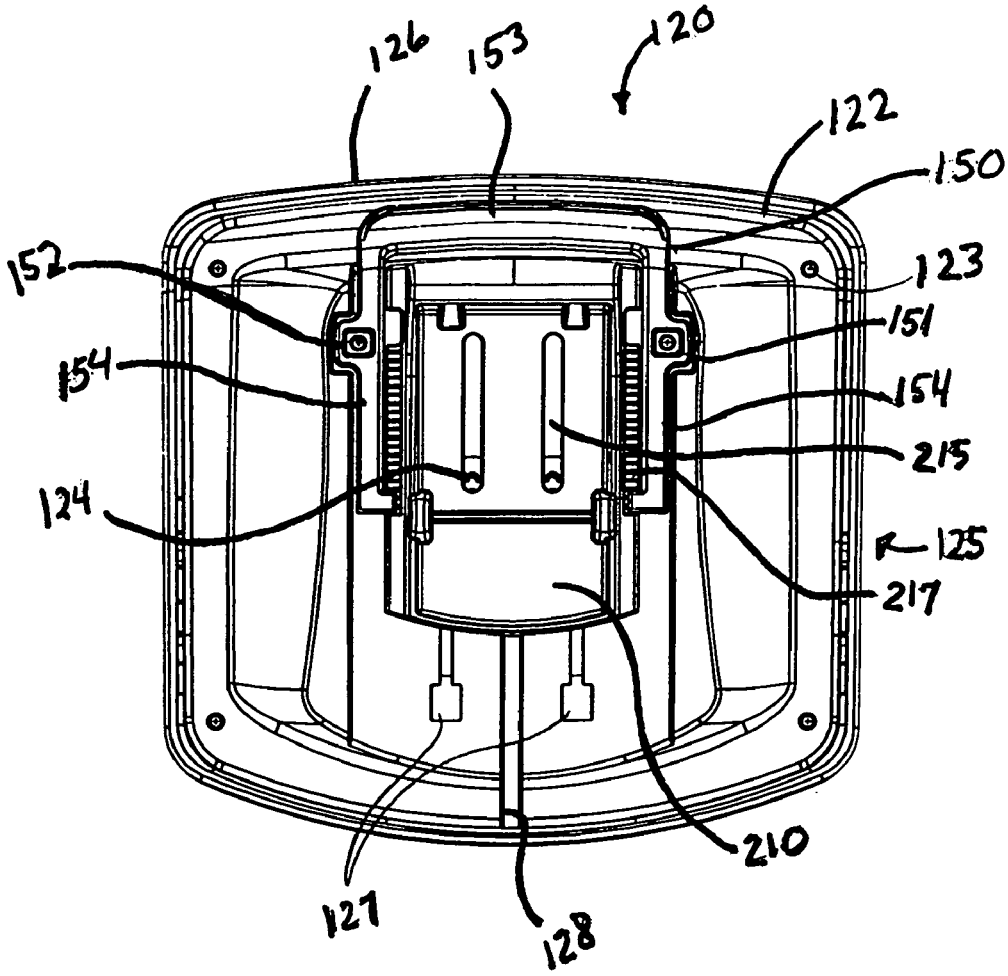
FIG. 8 is a bottom view of a portion of the seat structure of FIG. 7.
Figure 9:
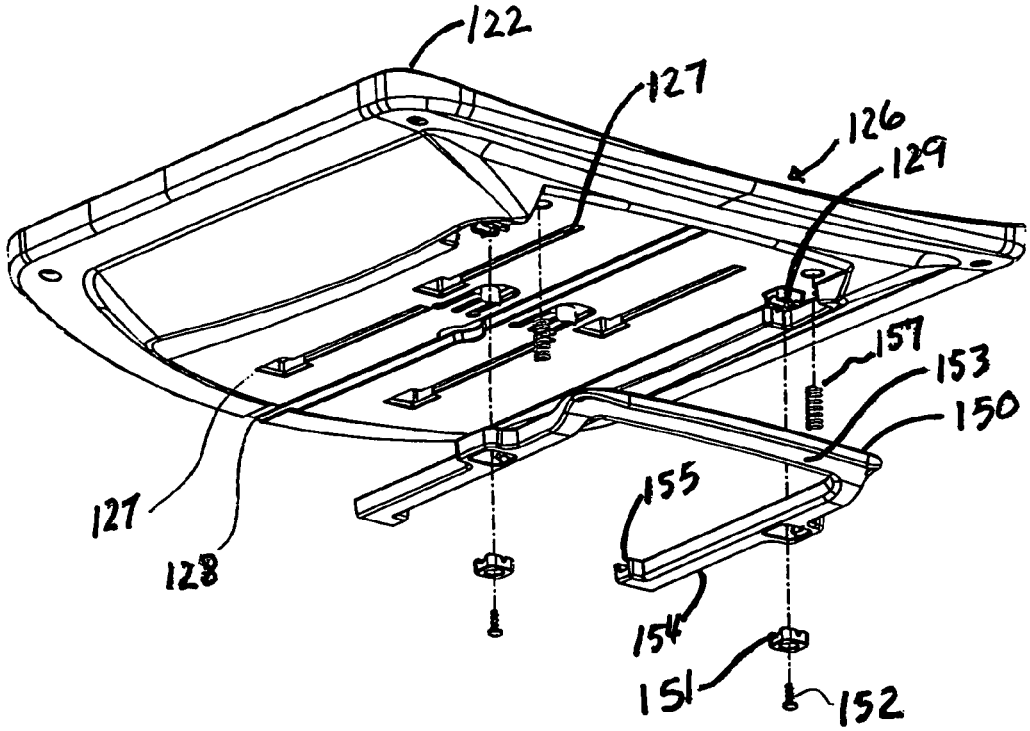
FIG. 9 is an exploded view of a seat pan and locking lever.
Figure 10:
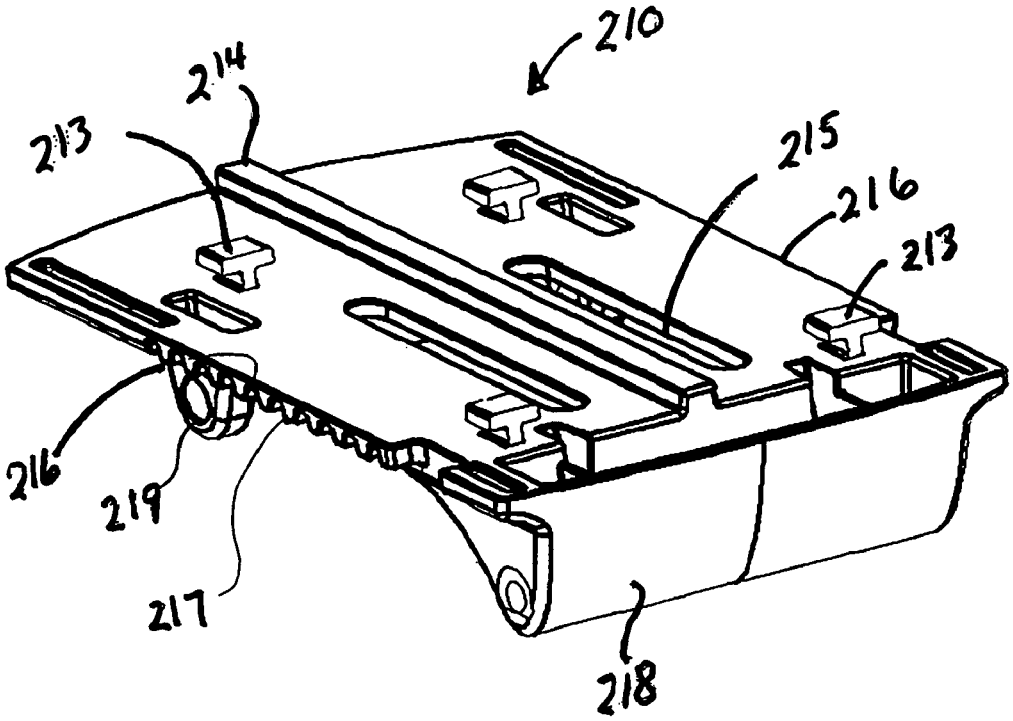
FIG. 10 is a perspective view of a seat plate used in the seat structure in FIG. 7.
Figure 11:
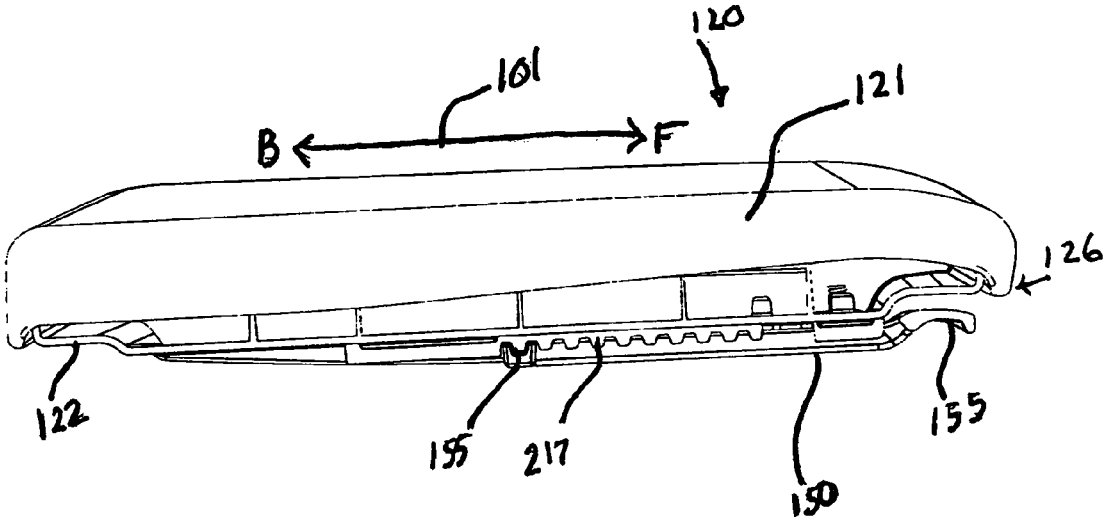
FIG. 11 is a left side view of a portion of the seat structure with the locking lever in a locked position.
Figure 12:
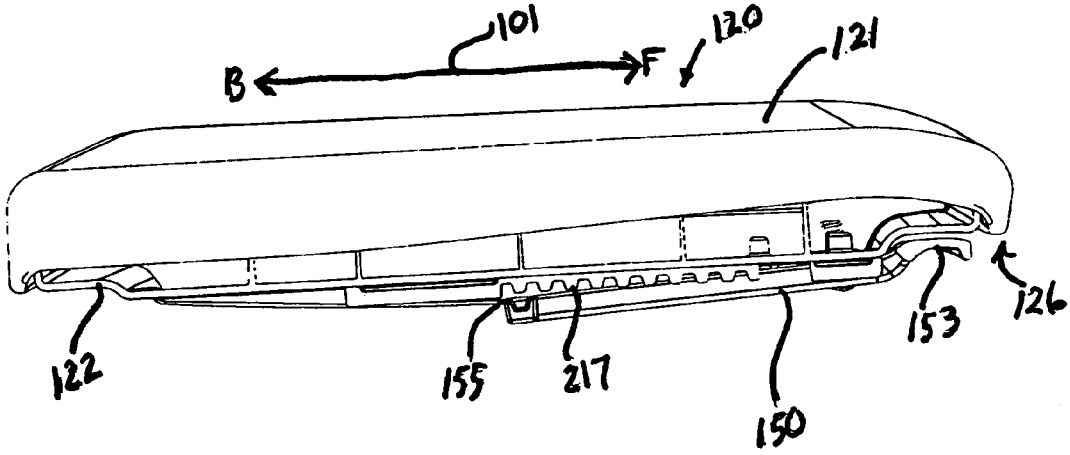
FIG. 12 is the seat structure of FIG. 11 with the locking lever in an unlocked position.

FIGS. 1-3 show a first embodiment of a reclining chair 100, and FIGS. 4-6 show a second embodiment of a reclining chair 105, in accordance with the present invention. The first chair 100 includes a back 110, a seat 120, a base 130, arms 140 and a control mechanism 200. The second chair 105 includes a back 115, a seat 120, a base 130, arms 145 and a control mechanism 200. The backs 110, 115, the seats 120 and the arms 140, 145 all attach to the control mechanisms 200, which are mounted on the bases 130. In FIGS. 1, 2, 4 and 5, the chairs 100, 105 are in an upright position. In FIGS. 3 and 6, however, the chairs 100, 105 are shown in a reclined position.

In the first embodiment, the chair back 110 includes a frame 111 and an area of mesh fabric 112 attached to the frame 111. The back 110 attaches to the control mechanism 200 at back pivots 113. In the second embodiment, the chair back 115 includes a frame 116 and an upholstered portion 117. The back 115 attaches to the control mechanism 200 at back pivots 118. The backs 110, 115 will be discussed in more detail below.

The arms 140, in the first embodiment, are a fixed design that attach to the control mechanism 200. The arms 145 in the second embodiment are an adjustable design that attach to the control mechanism 200. The arms 145 include padded arm rests 146 and a mechanism 147 for raising or lowering them. In addition, the arm rests 146 are configured to move inward and outward and forward and backward. Alternatively, chairs 100, 105 may be provided without any arms. Numerous types and styles of chair arms 140 are also usable with chairs 100, 105, as would be known to one of ordinary skill in the art, including arms that are adjustable at an angle with respect to the seat. All such arm configurations are within the scope of the present invention.

Although the back style 110, 115 and arm style 140, 145 varies between chair 100 and chair 105, the seat 120, base 130 and control mechanism 200 are all the same. These components will be referred to hereinafter with respect to only chair 100 for clarity during the discussion. However, it is to be understood that this discussion applies equally to the second embodiment chair 105 and any other variation described herein or contemplated based on this invention.

The base 130 includes a central column 131 supported by a plurality of outwardly projecting base legs 134. Each base leg 134 is provided with a caster 135 configured to swivel and roll so as to move the chair 100. In some embodiments, each caster 135 may include a locking mechanism. The central column 131 preferably includes a pneumatic or gas cylinder having a fixed outer cylinder 132 and a movable inner cylinder 133 attached to the control mechanism 200. Activation of a height adjustment lever 136 results in upward or downward movement of the control mechanism 200, and thus the backs 110, 115, seats 120 and arms 140, 145, as is known in the art.

Referring now to FIGS. 7-12, the seat 120 preferably includes an upholstered foam assembly 121 mounted to a rigid seat pan 122 with fasteners 123 or by another suitable method. The seat pan 122 includes one or more seat posts 124 protruding from the side opposite the foam assembly 121 or underside 125 of the seat pan 122. The seat posts 124 may be attached to, or formed integrally with, the seat pan 122, as desired. The seat pan 122 also includes one or more T-slots 127 and a center channel 128 formed within the underside 125.

A generally U-shaped, pivoting locking lever 150 is mounted to the underside 125 of the seat pan 122 at pivot mounting elements 129 using pivot blocks 151 and fasteners 152. (The pivot blocks 151 and pivot mounting elements 129 are described in more detail below.) The lever 150 includes a lever handle 153 interposed between two legs 154. The lever handle 153 is positioned near a front edge 126 of the seat pan 122 when the lever 150 is mounted to the seat pan 122. Each lever leg 154 includes a notched protrusion 155 provided on an end 156 opposite from the lever handle 153. Springs 157 are also provided to bias the lever 150 into a 'locked' position relative to the seat pan 122, such that the notched protrusions 155 are forced upward toward the underside 125 of the seat pan 122. Although shown as a U-shaped member, the locking lever 150 could alternatively be provided as an L-shaped member having a handle and only one leg, or another suitable configuration.

The control mechanism 200 includes a seat plate 210 having a top side 211 and a bottom or underside 212. On the top side 211, the seat plate 210 includes two pairs of T-shaped protrusions 213 and a center rib 214. In addition, there are two slots 215 formed through the seat plate 210 and positioned on either side of the center rib 214. Along each edge 216 are a series of teeth 217 formed on the underside 212 of the seat plate 210. An extended lip 218 is also provided on the underside 212 for connection of the seat plate 210 to the back upright 230 at pivot 201.

The seat 120 slidably mounts to the seat plate 210 of the control mechanism 200 by insertion of the seat posts 124 into the slots 215 in the seat plate 210, insertion of the T-shaped protrusions 213 into the T-slots 127 and insertion of the center rib 214 into the center channel 128. The locking lever 150 is then installed and attached to the seat pan 122, such that the two notched protrusions 155 are positioned to mate with and engage the teeth 217 on the seat plate 210, as shown in detail in FIG. 11. In its normally locked position, engagement of the teeth 217 by the locking lever 150 keeps the seat stationary with respect to the seat plate 210 (and thus the control mechanism 200).

A user seated on the seat 120 may desire to adjust the seat position in a forward (F) or backward (B) movement, per directional arrows 101, in order to accommodate the user's size or preferred fit of the chair 100. As a result, the seat 120 moves relative to the control mechanism 200 and, thus, to the arms 140 and back 110, which are attached to the control mechanism 200. In order to make the adjustment, the user reaches under the front edge 126 of the seat 120 with either hand and lifts the lever handle 153, preferably by grasping the seat 120 and handle 153 and squeezing. The locking lever 150 pivots about the pivot blocks 151 resulting in the notched protrusions 155 disengaging from the teeth 217, as shown in detail in FIG. 12. The seat 120 is then free to slide along the slots 215 to a desired new position. Once the desired position is attained, the user releases the handle 153 and the notched protrusions 155 re-engage the teeth 217 due to the force of the springs 157.

Figure 13:
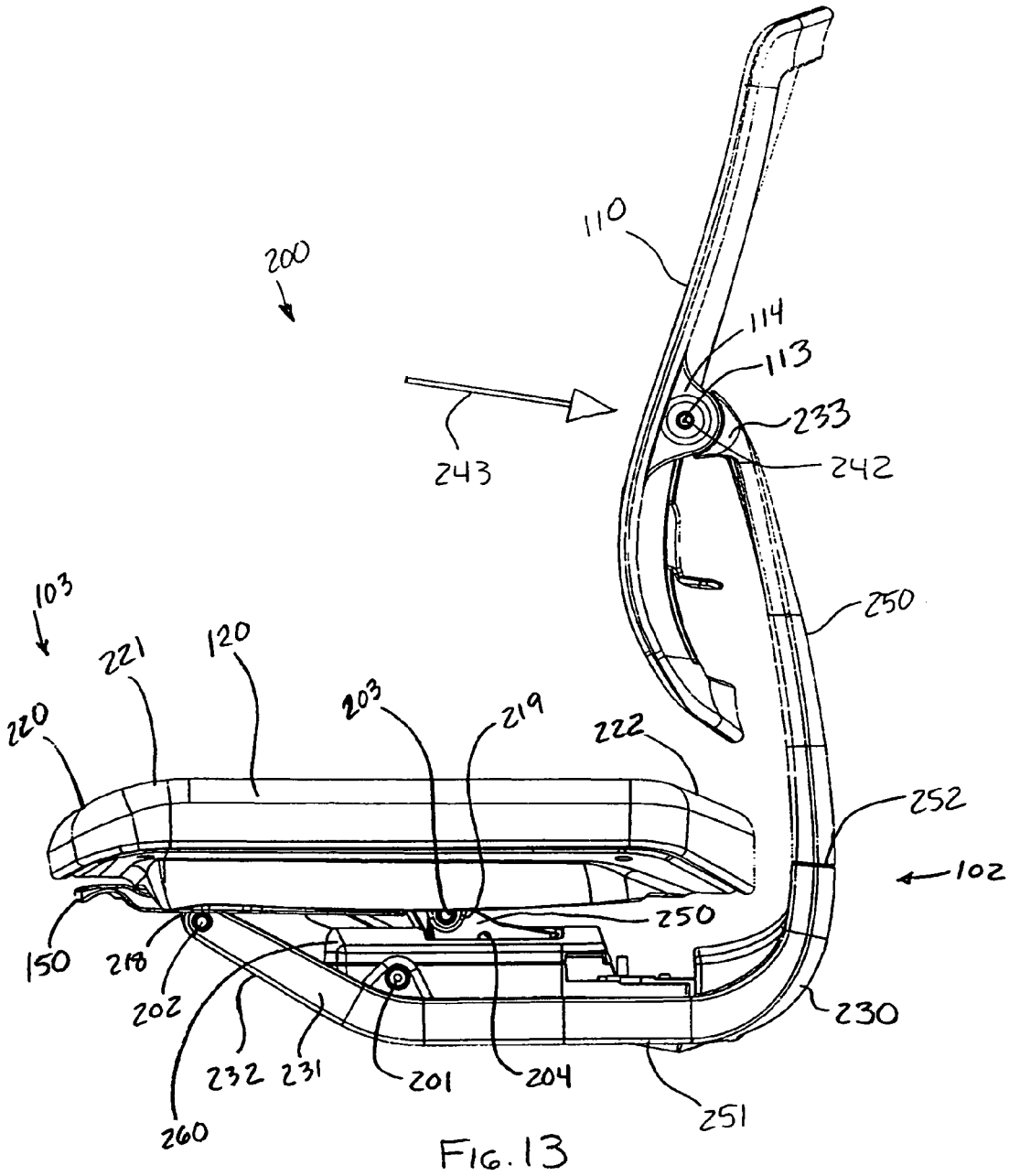
FIG. 13 is a partial right side view of the chair of FIGS. 1 and 2, including the back, seat structure and control mechanism shown in an upright position.
Figure 14:
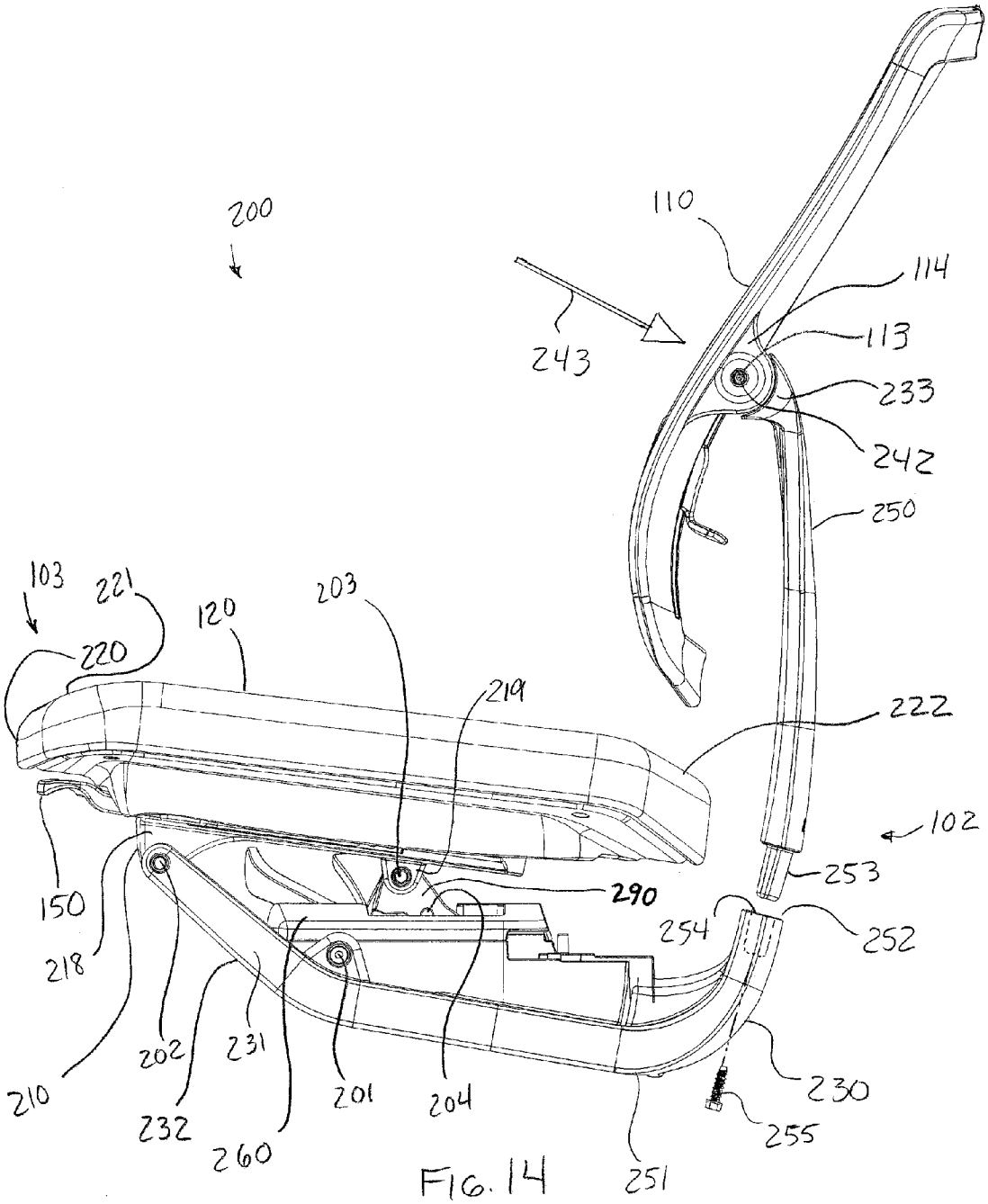
FIG. 14 is the chair portion of FIG. 13 shown in a reclined position.

Referring now to FIGS. 13 and 14, the control mechanism 200 is shown with the seat 120 and back 110, but without chair arms 140, 145. It includes the seat plate 210, a back upright 230, a rear link 290 and a control body assembly 260. The control mechanism 200 functions as a four-bar mechanism, with the control body assembly 260, or control hub, acting as the "ground" for this mechanism. This mechanism 200 includes a first pivot 201 between the back upright 230 and the ground 260, a second pivot 202 between the back upright 230 and the seat plate 210, a third pivot 203 between the seat plate 210 and the rear link 290, and a fourth pivot 204 between the rear link 290 and the ground 260. A portion 232 of the back upright 230 between the first pivot 201 and second pivot 202 functions as the driver of the four-bar mechanism, the seat assembly 220 (that is the seat 120 attached to the seat plate 210) functions as the coupler, and the rear link 290 functions as the follower.

Viewed from the side, the back upright 230 is a generally J-shaped, rigid unit extending from a central region of the chair back 110 at the back 102 of the chair 100, downward, under the seat 120, and forward, to the front 103 of the chair 100. In one embodiment, the back upright is split into an upper part 250 and a lower part 251 joined together at a joint 252 located near a rearward portion 222 of the seat 120. In this embodiment, the joint 252 is formed with a male portion 253 on the upper part and a female portion 254 in the lower part, which are held together by fastener 255. Providing the back upright 230 in multiple parts allows for more compact shipping of the chair 100. In addition, it facilitates more efficient (and thus cost effective) manufacturing and assembly.

Figure 15:
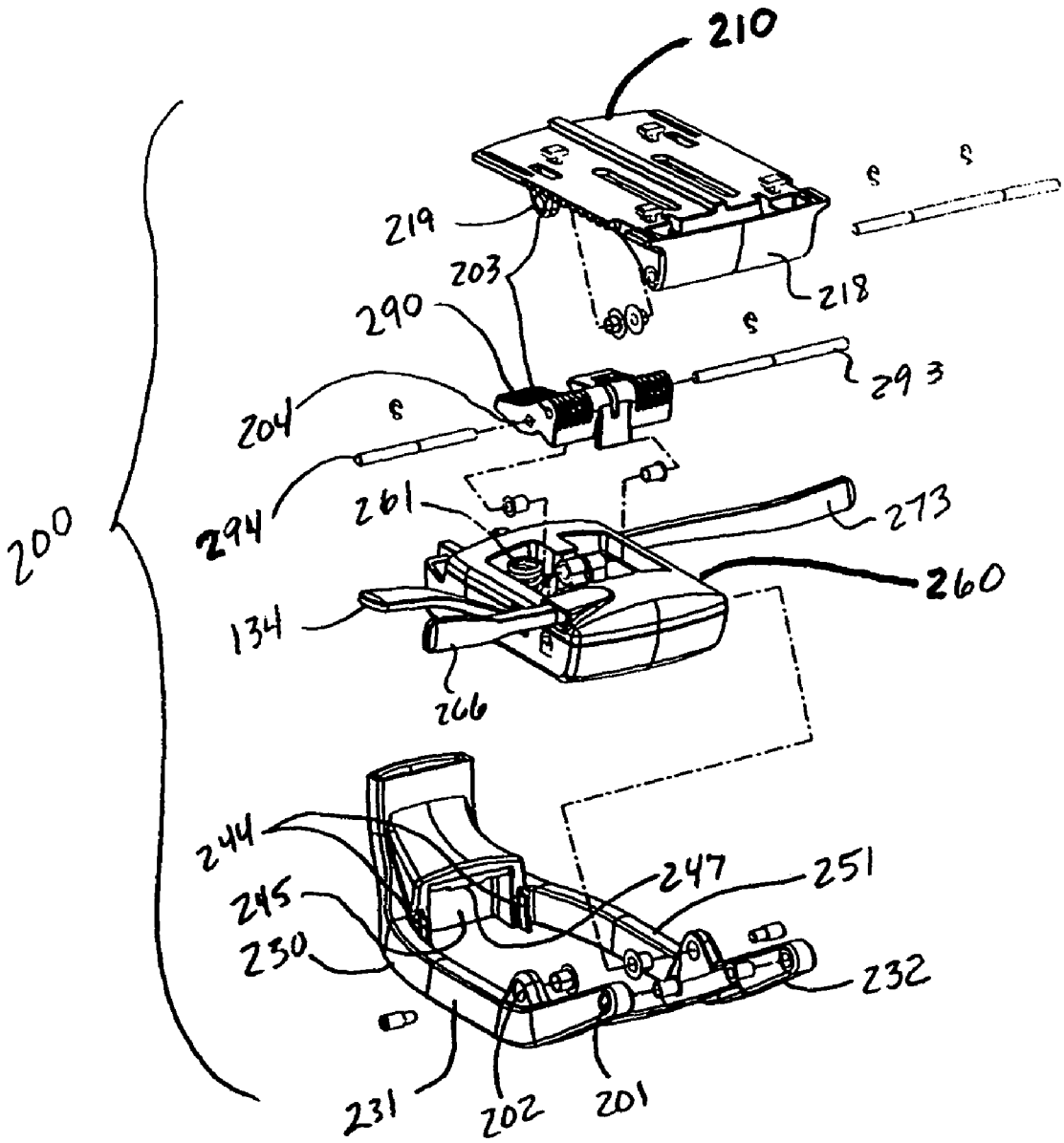
FIG. 15 is an exploded view of the control mechanism, excluding the upper part of the back upright.
Figure 16:
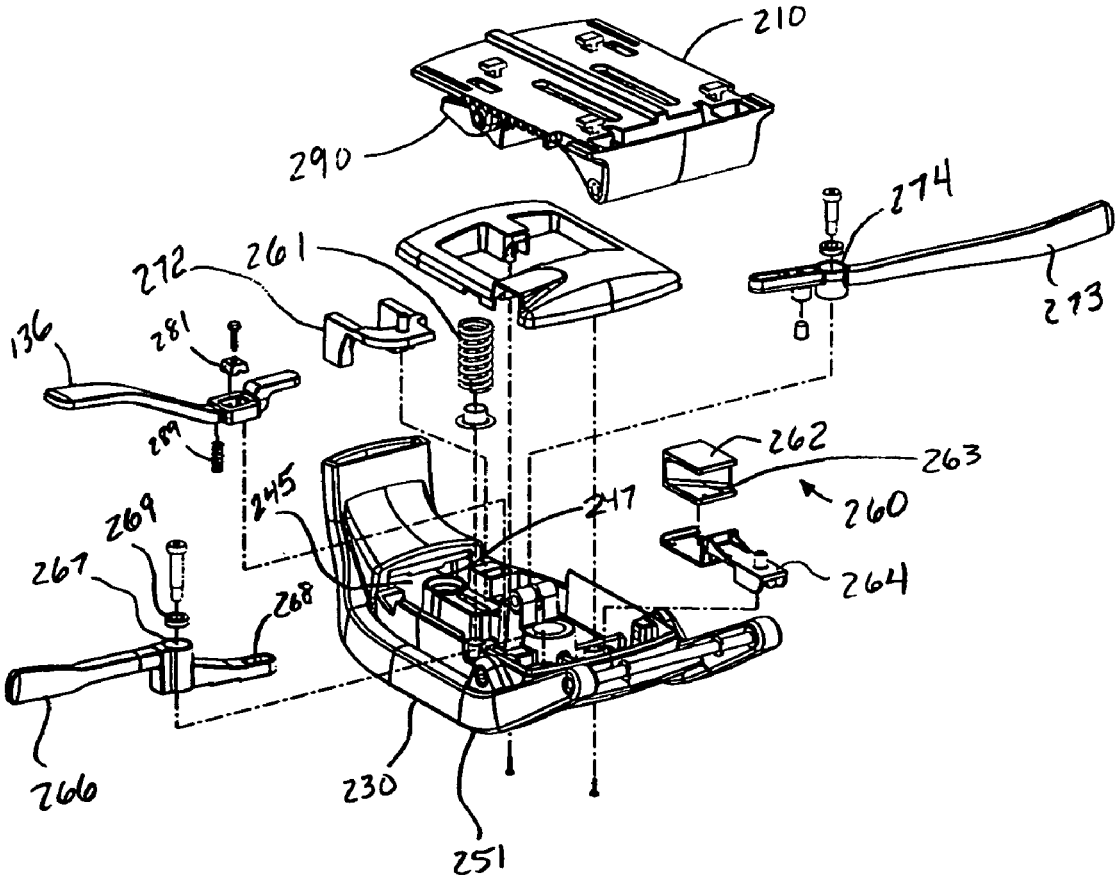
FIG. 16 is another exploded view of the control mechanism of FIG. 15 showing the control body components.

As described in more detail below and shown in FIG. 1, at the back 102 of the chair 100, the upper part 250 of the back upright 230 splits in a generally 'Y' shape, ending at pivots 113 on either side of the chair back 110. At the front 103 of the chair 100, the bottom part 251 of the back upright 230 splits into two parallel forks 231, between which the control body 260 is positioned, as shown in FIGS. 15 and 16.

When a user seated in the chair 100 reclines the chair 100, as shown in FIGS. 3, 6 and 14, a force is applied to the chair back 110 and to the upper part 250 of the back upright 230 causing it to pivot about the first pivot point 201. The relative motion between the back upright 230 and the seat assembly 220 is defined by the second pivot point 202. This pivot point 202 is the most forward pivot point of the four-bar mechanism. As the user reclines, the position and angle of the coupler, or seat assembly, 220 changes in both the horizontal and vertical directions. In effect, the force applied to the back upright 230 is re-directed by the back upright 230 and the four bar mechanism 200 to lift the seat assembly 220. That is, the chair 100 utilizes both the user's weight and the user applied reclining force to help lift the user.

Referring now to FIGS. 13 and 17-21, the back pivot 113 is shown in more detail. As stated above, the back upright 230 is attached to the chair back 110 at pivots 113. In this embodiment, the upper part 250 of the back upright 230 includes a tri-lobed pivot coupler 233 that mates with a C-shaped back bracket 114, and is connected to the bracket 114 by a pin 234 held in place by a clip 240 forming joint 241. This type of joint 241 is provided for structural and stability purposes, however, any pivot joint could be used in this application, as would be known in the art. All such pivot joints are within the scope of the present invention.

Figure 17:
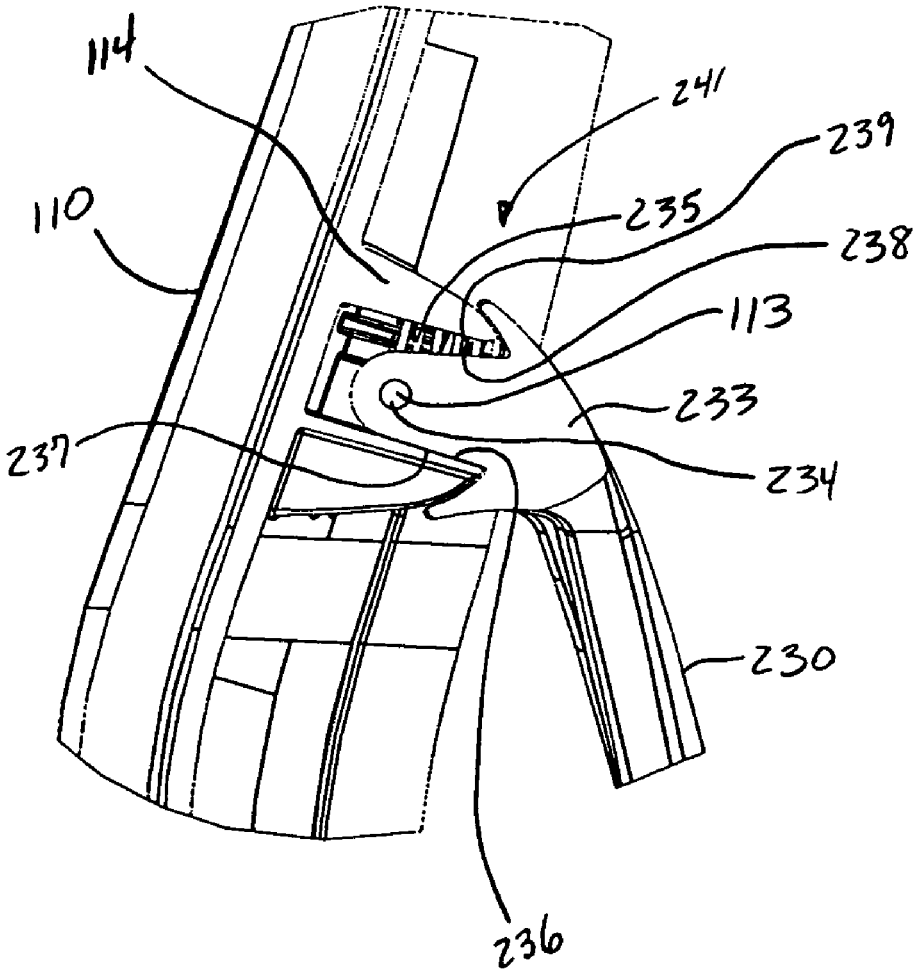
FIG. 17 is a partial detailed side view of a chair back pivot shown for a chair in the upright position.
Figure 18:
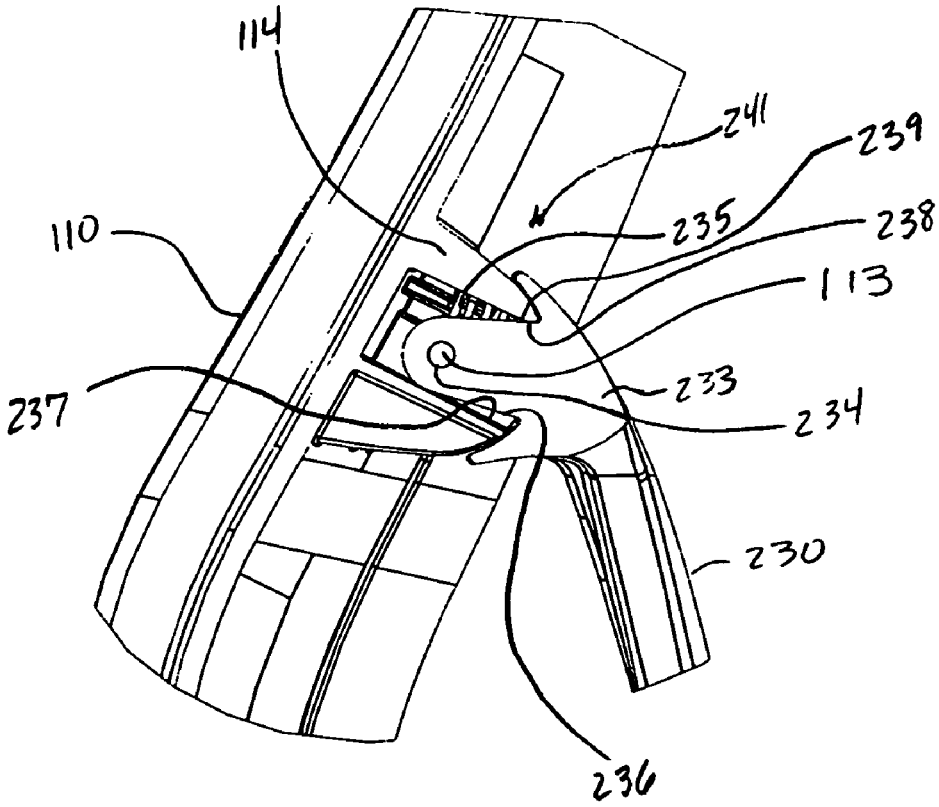
FIG. 18 is the pivot of FIG. 17 with the chair in the reclined position.
Figure 19:
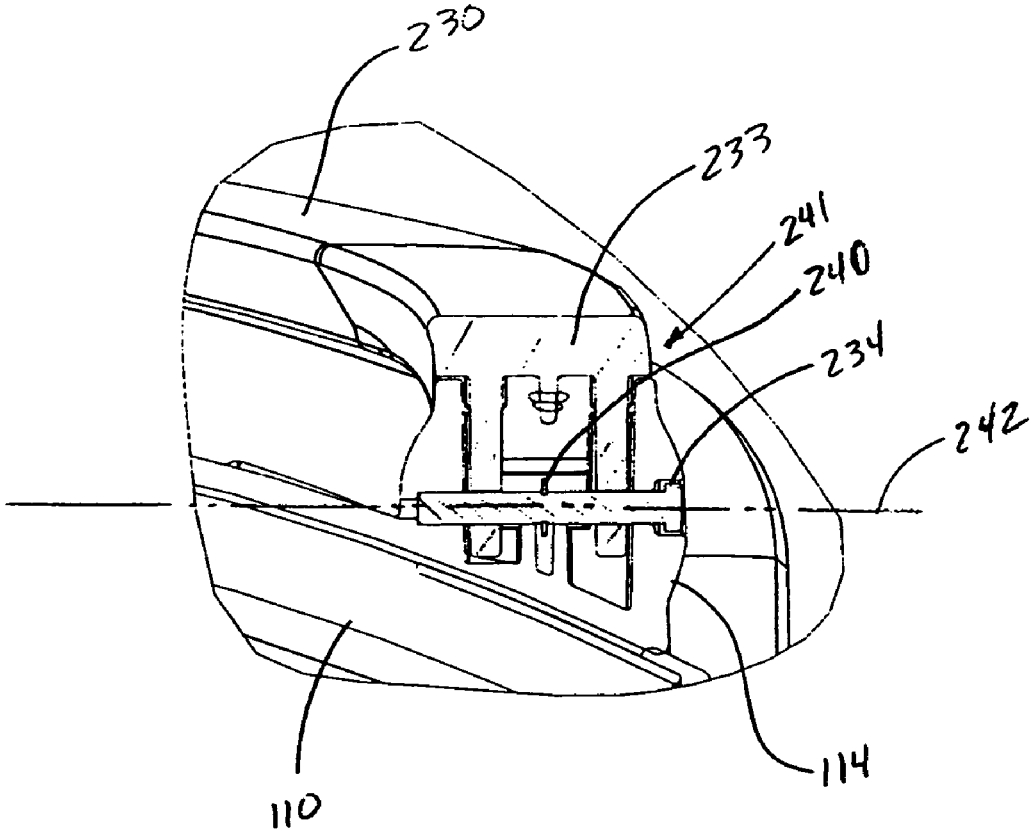
FIG. 19 is a top cross-sectional view of the pivot of FIGS. 17 and 18.

The joint 241 is spring loaded with a predetermined preload by compression of spring 235 positioning the back 110 in the upright position by default and providing a resistance to rotation during reclining of the chair 100. In the upright position, as shown in FIG. 17, the back 110 is positioned appropriately relative to the back upright 230 due to limits provided by an upright stop 236 on the pivot coupler 233 engaged with an upright bracket stop 237 on the back bracket 114. In the reclined position, a reeline stop 238 on the pivot coupler 233 engages a recline bracket stop 239 on the back bracket 114 as a limit to the rotation of the back 110 relative to the back upright 230. There are two such pivot joints 241 provided on the chair 100. They are coaxial and equidistant from a center plane datum. The purpose of two pivot joints 241 is to bring a pivot axis 242 closer to the user's spine. This can be accomplished as a result of the curvature of the chair back 110.

Figure 20:
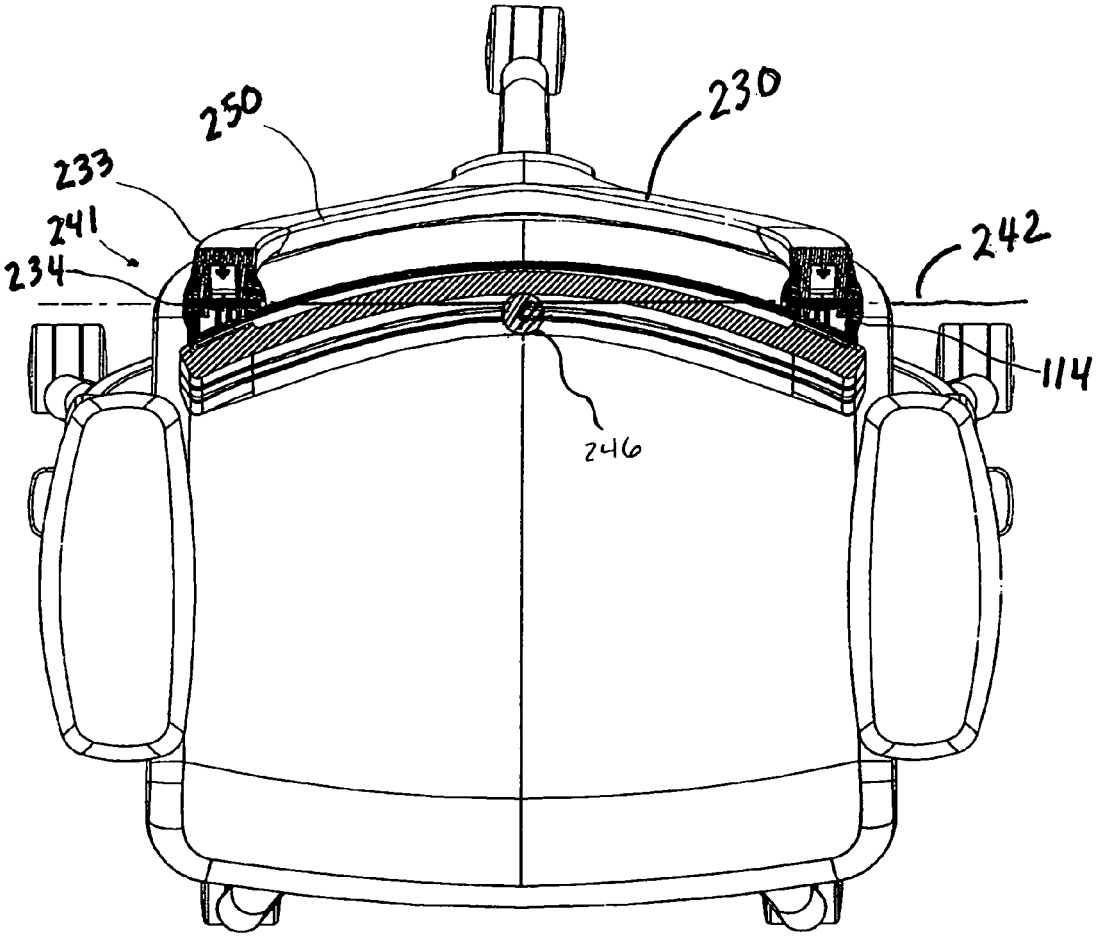
FIG. 20 is a partial top cross-sectional view of the chair back of FIGS. 17-19, showing the pivot axis and user's spine location.

The pivot axis 242 of the back 110 relative to the back upright 230 runs through the joint 241 at pins 234. This axis 242 is positioned near the center of force 243 of the seated user in the vertical direction, as shown in FIGS. 13, 14 and 20. The purpose of this position is to allow the chair back 110 to passively adapt to the user's torso movements. If the pivot axis 242 was vertically above the center of force 243 it would not rotate during the recline motion of the chair 100 and therefore would allow separation between the user's back and the chair back 110 itself. If the pivot axis 242 were vertically below the user's center of force 243, the chair back 110 would rotate to its rearward stop 239 relative to the back upright 230 before the recline of the chair 100 began. The user's center of force 243 is near the center of mass for the user's torso.

The purpose for the horizontal positioning of the pivot axis 242 relative to the user's spine (as represented by item 246) is to promote proper spinal positioning as the chair back 110 rotates. If it were horizontally behind the user's spine 246, the chair back 110 would improperly lift the user's lower back and push the user out of the chair 100. If it were horizontally off in either direction it would cause slipping between the chair back 110 surface and the user's back.

The control mechanism 200 and the back pivot 113 of the present invention, as described above, combine together to provide a chair 100 in which shear and pull-away forces on the user's back, as encountered in other reclining chairs, have been substantially reduced, if not eliminated. As a result, the user experiences a comfortable and customized fit, including proper back support both in an upright and reclined position. Increased comfort of a work chair will aid in producing higher productivity and reduced discomfort, fatigue or other negative physical issues for the user.

Figure 21:
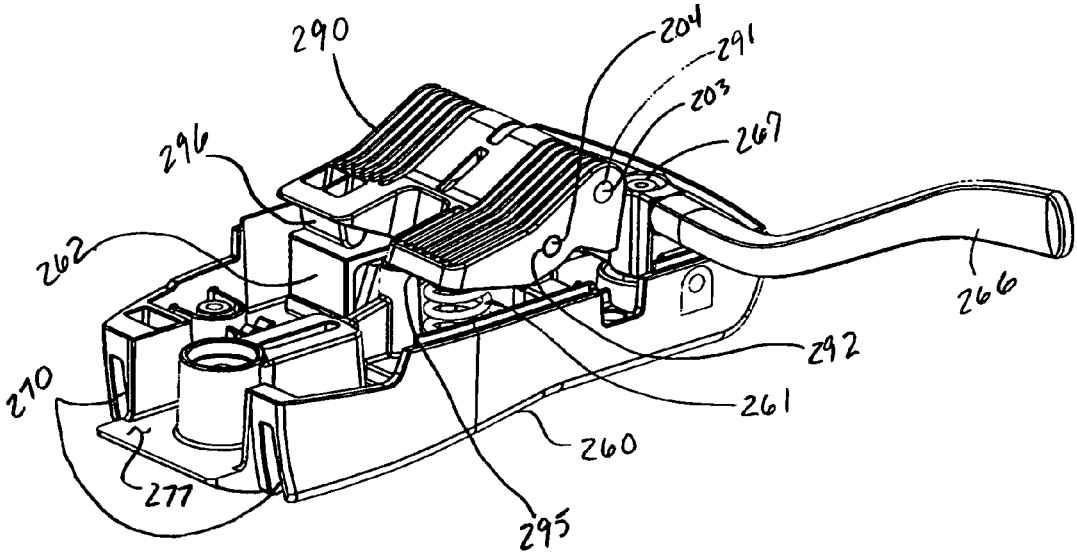
FIG. 21 is a detailed partial view of the control body and rear link assembly, including the tension adjustment lever.
Figure 22:
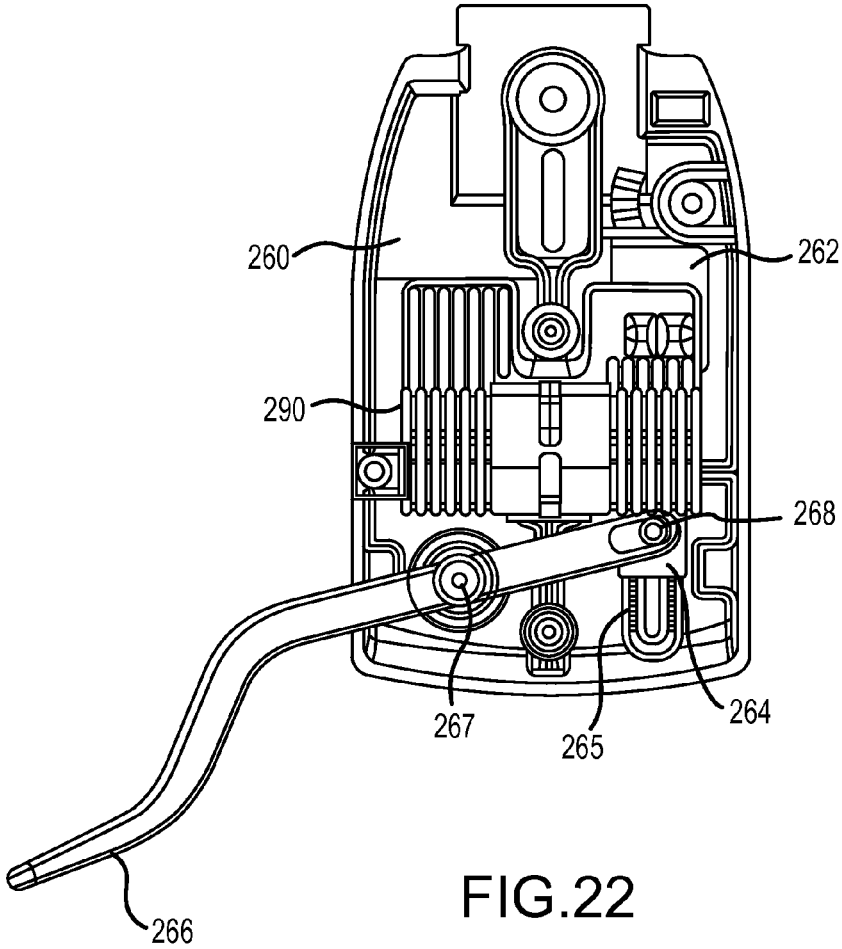
FIG. 22 is a top view of the assembly of FIG. 21 with the tension slider in a rearward most position.
Figure 23:
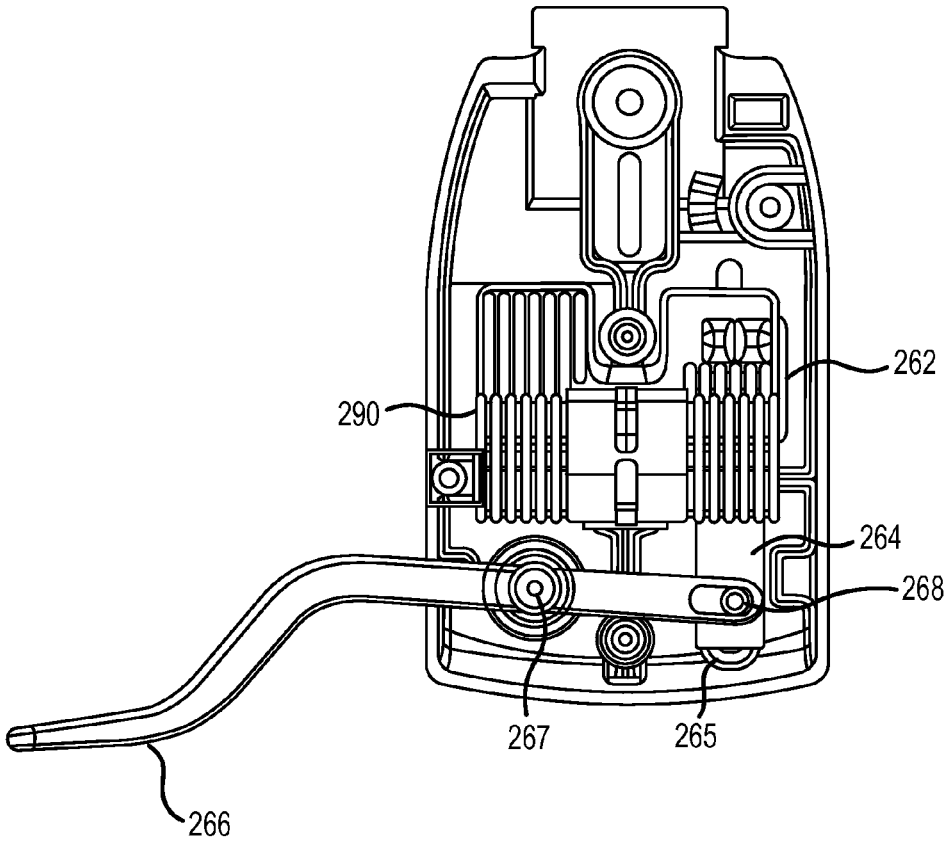
FIG. 23 is the assembly of FIG. 22 with the tension slider in a forward most position.

Referring now back to FIGS. 15 and 16, along with FIGS. 21-23, the rear link 290 is formed as a generally wedge-shaped member including two bores 291, 292 that correspond to the third and fourth pivots 203, 204, respectively. Shafts 293 and 294 couple the rear link 290 to the seat plate 210 and control body 260 at the bores 291, 292, respectively.

The control body 260 includes a spring 261 which acts between the rear link 290 and the ground 260. Upon removal of the reclining force, the chair 100 returns to its upright and forward position due to the action of the spring 261 in combination with the weight of the user. In one embodiment, the spring 261 is provided as a steel coil spring that is pre-loaded. The rear link 290 includes a generally flat under surface 295 positioned to engage the coil spring 261. The size, spring strength, location and style of the spring 261 allow it to provide the desired return effect while adding minimal resistance to the recline of the chair 100.

The control body 260 also includes a second spring 262 that acts between the rear link 290 and the ground 260. This second spring 262 is formed from a block of resilient material having a varying resistance to compression. By adjusting the location of the second spring 262 within the control body 260 relative to the rear link 290, the chair's resistance to the reclining of the chair back 110, that is, the chair's tilt tension, can be varied.

In this embodiment, the varying resistance to compression of the spring 262 is provided by changing the geometry of the spring 262, such as by changing the amount of resilient material that resists compression within the spring 262. This change results from the removal of a wedge-shaped volume of material 263 from the interior of the block of resilient material. Alternatively, this change could be achieved by changing the material, such as by varying the density, formulation or other material characteristics of the spring. Other methods of varying the resistance to compression of the spring 262 may also be utilized, as are known in the art, and all such embodiments are contemplated by and within the scope of the present invention.

The rear link 290 also includes a downwardly protruding element 296 positioned over the resilient second spring 262. In this embodiment, the element 296 is generally configured as a trapezoidal prism having a radiused end that engages the resilient spring 262. The curved shape of the protrusion 296 provides a discrete area of contact with the resilient spring 262, thereby more accurately conveying the changes in resistance as the spring 262 is moved relative to the protrusion 296. In addition, the curved shape prevents the sliding of the spring 262 with respect to the protrusion 296 since the resilient material can wrap around this protrusion 296 as it is compressed.

The resilient spring 262 is held within a slider 264 that is mounted upon a track 265 in the control body 260, as shown in FIG. 22. Protrusions on a bottom side of the slider 264 engage with notches on the track 265 to provide detent locations for the slider 264. A slider or tension lever 266 is pivotally mounted to the control body 260 at slider pivot 267 and moveably coupled to the slider 264 at interface 268. The tension lever 266 extends from the control body 260 to the side of the chair 100 and may be moved forward and backward relative to the control body 260. As the lever 266 is moved by the user, the slider 264 moves the resilient spring 262 underneath the protrusion 296 of rear link 290, thereby changing the chair's resistance to being reclined or tilt tension. Movement of the slider 264 relative to the notched track 265 requires a slight upward movement of the slider 264 over each notch. This upward movement is accommodated through a compliant washer assembly 269 at slider pivot 267. The initial compression of this washer assembly 269 dictates the force required to move between the detent positions on the track 265. The limited distance motion of the tension lever, coupled with the tactile sensation of the notched track, provide a user with perceivable feedback concerning the tilt tension adjustment range and user's adjustments within that range.

Figure 24:
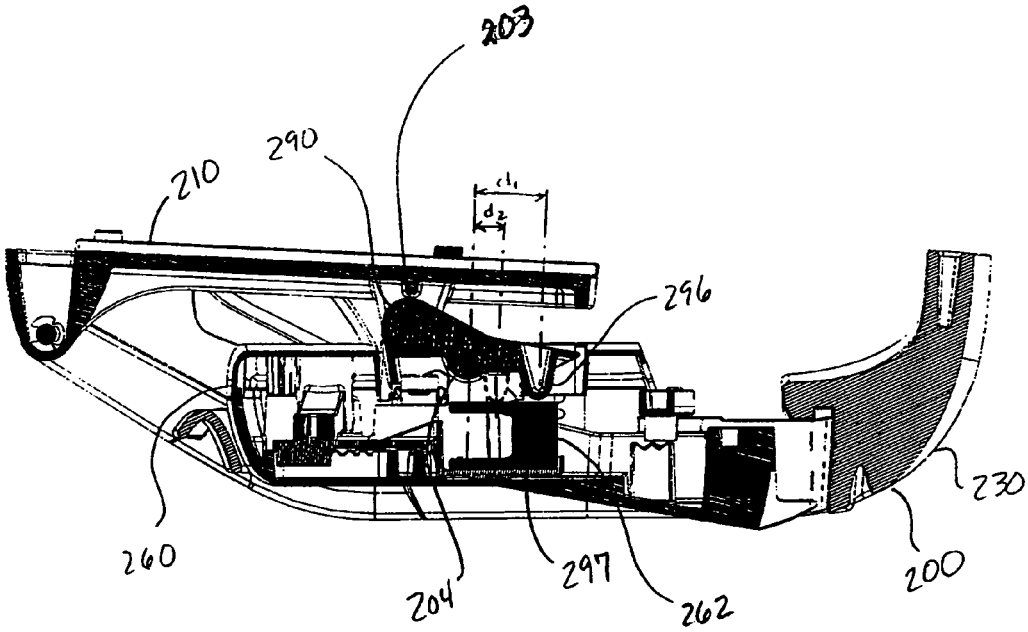
FIG. 24 is partial cross-sectional view of a control mechanism showing an optional adjustment of the rear link protrusion.

Alternatively, instead of sliding the resilient spring having a varying resistance to compression, such as spring 262, forward and backward relative to the rear link 290, the spring could be moved from side to side. Another option would be to rotate the resilient spring to present a greater or smaller resistance to compression. Further, the protrusion 296 could also be movable with respect to the main portion of the rear link 290, as well as the spring, in order to obtain even more adjustment of the tilt tension. Referring now to FIG. 24, a cross-section of the control mechanism 200 is shown with rear link 290 having protrusion 296 positioned to engage and bear upon resilient spring 262 when the back upright 230 is reclined by a user. A distance from the fourth pivot 204 to the protrusion 296 is shown by a first distance, $d_1$. In the option just described, a repositioned protrusion 297 is shown at a new distance, $d_2$, from the fourth pivot 204. This type of adjustment then would affect the relationship of the rear link 290 and the resilient spring 262, providing further adjustability for the user. Optionally, the spring may be positioned to engage and be activated by another portion of the control mechanism 200, such as the back upright 230 or the seat plate 210. All such variations of using such a spring are within the scope of the present invention.

When a user sits down in the chair 100, the four-bar control mechanism 200 of the present invention biases the mechanism 200 forward against an upright stop 205 due to the weight of the user. As a result, a minimal load is placed on the first and second springs 261, 262, thereby allowing for quick and easy adjustments of the reclining resistance or tilt tension. Coupled with the limited motion tension adjustment slider 264 described above, the present invention provides an adjustment mechanism that is easier to locate, operate, and utilize to provide changes to the tilt resistance by any user of the chair 100.

The upright stop 205 is formed from the interface between the control body 260 and back upright 230. In this embodiment, the stop 205 is provided by two rectangular protrusions 244 on the lower back upright 230, as shown in FIG. 15, that fit into rectangular cutouts 270 in the control body 260, as shown in FIG. 21. The stop 205 occurs when a top portion of the protrusions 244 engages with a top surface of the cutouts 270. The location of the stop 205 creates a direct stop wherein the force required to stop the mechanism 200 only flows between the lower part 251 of the back upright 230 and the control body 260. Therefore, the other components of the mechanism 200 do not need to be designed to accommodate this force, resulting in more economical components and streamlined assembly.

Figure 25:
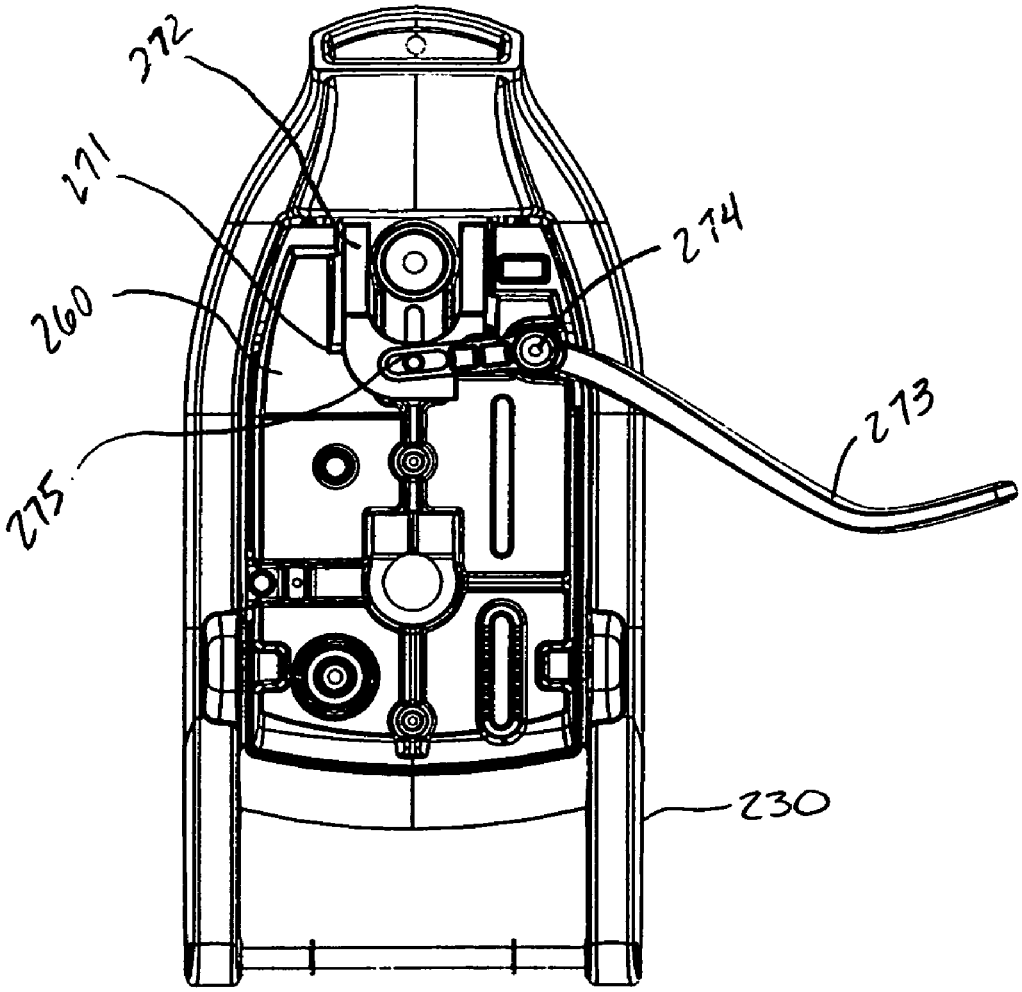
FIG. 25 is a top view of a portion of the back upright and control body assembly, including the tilt lock mechanism in an unlocked position.
Figure 26:
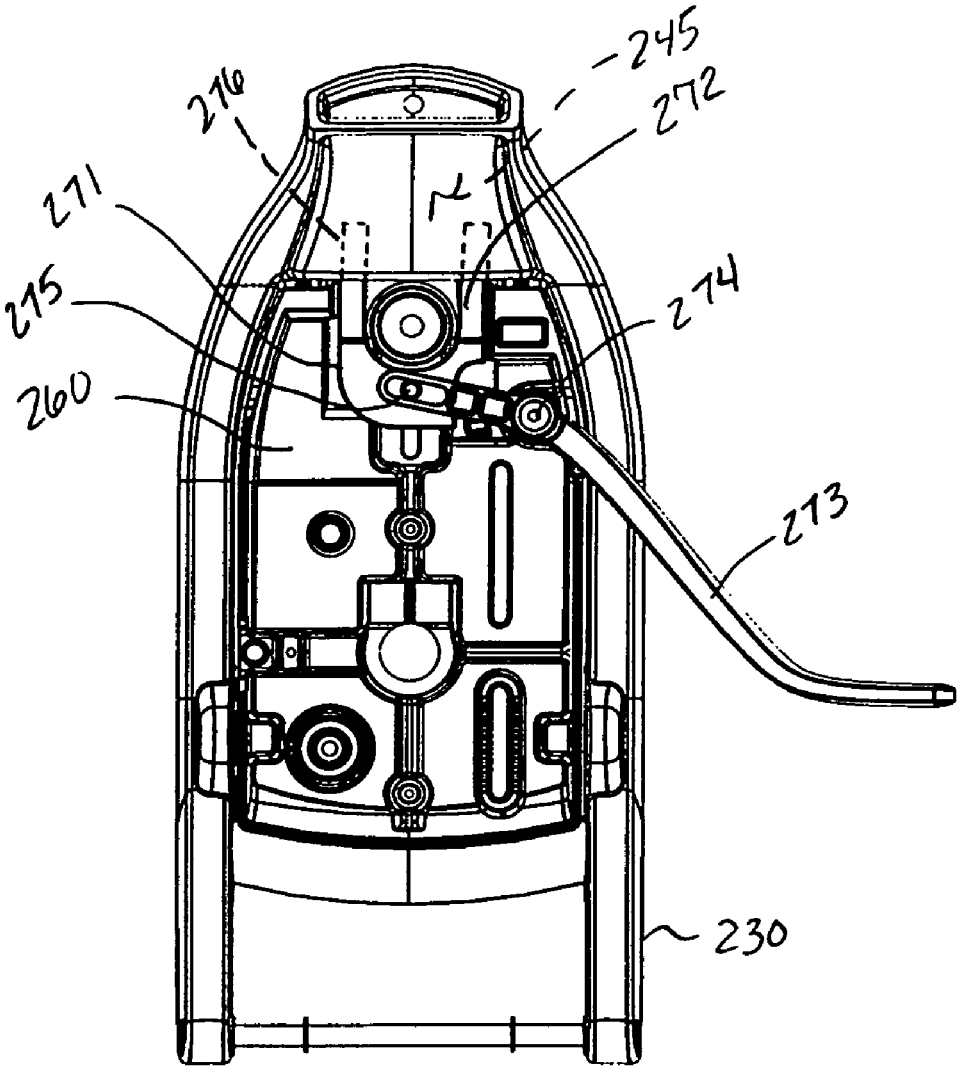
FIG. 26 is the assembly of FIG. 24 with the tilt lock mechanism in a locked position.

The chair 100 of the present invention also includes a tilt lock 271 provided to lock the chair back 110 in the upright position, as shown in FIGS. 16, 25 and 26. The optimal place to stop the recline of the chair 100 is off of the driver of the mechanism 200, which, in this invention, is the back upright 230. In addition, it is desirable to provide the stop as far as possible from the reclining pivot point, that is, the first pivot 201, in order to minimize any effects of tolerance in the interface at the stop. In this invention, the tilt lock 271 is mounted within the control body 260 and configured to engage and disengage the lower part 251 of the back upright 230 at recess 245 formed within the lower part 251.

In this embodiment, the tilt lock 271 includes a generally U-shaped tilt-lock slider 272 mounted within the control body 260. The tilt-lock slider 272 is coupled to a tilt-lock lever 273 extending outward from the control body 260 on the side of the chair 100. The lever 273 is pivotally mounted to the control body 260 at pivot 274, in the same manner as pivot 267 for tension lever 266 described above. The lever 273 is then moveably coupled to the tilt-lock slider 272 at interface 275, also in the same manner as the slider 264 is coupled to tension lever 266 at interface 268. In operation, the user moves the tilt-lock lever 273 forward to move a lock portion 276 of the tilt-lock slider 272 into the tilt-lock recess 245 on control body 260, as shown by the dashed lines in FIG. 25. As a result, the back upright 230 is restrained from moving relative to the control body 260, and thus the chair 100 may not be tilted backward by the user, remaining in the upright position. The user then moves the lever 273 backward to remove the lock portion 276 out of the recess 245 and unlock the chair 100, allowing it to recline as desired by the user.

As described above, the forward motion of the chair 100 is limited by the upright stop 205. The rearward reclining motion of the chair 100 is limited in the locked configuration by the tilt lock 271. In an unlocked configuration, however, the rearward limit of the chair's reclining motion is provided by a full recline stop occurring when recline stop surface 247 on the lower part 251 of the back upright 230, shown in FIGS. 15 & 16, encounters stop surface 277 on the control body 260, shown in FIG. 21. This stop limits the recline motion of the control mechanism 200 to its full range of about ten degrees.

As shown in FIG. 16, in addition to the tension lever 266 and the tilt-lock lever 273, the control mechanism 200 further includes height adjustment lever 136 extending outward from the control body 260 on the side of the chair 100 within reach of the user. As described above, the height adjustment lever 136 is provided to activate the moveable gas cylinder 133 in order to move the seat 120 up or down to the user's desired height relative to the floor. The user pulls the height adjustment lever 136 upward toward the user to activate the cylinder 133, while applying weight to the seat 120 in order to lower the height of the seat 120 or removing weight in order to raise the height of the seat 120, as is known in the art.

Figure 27:
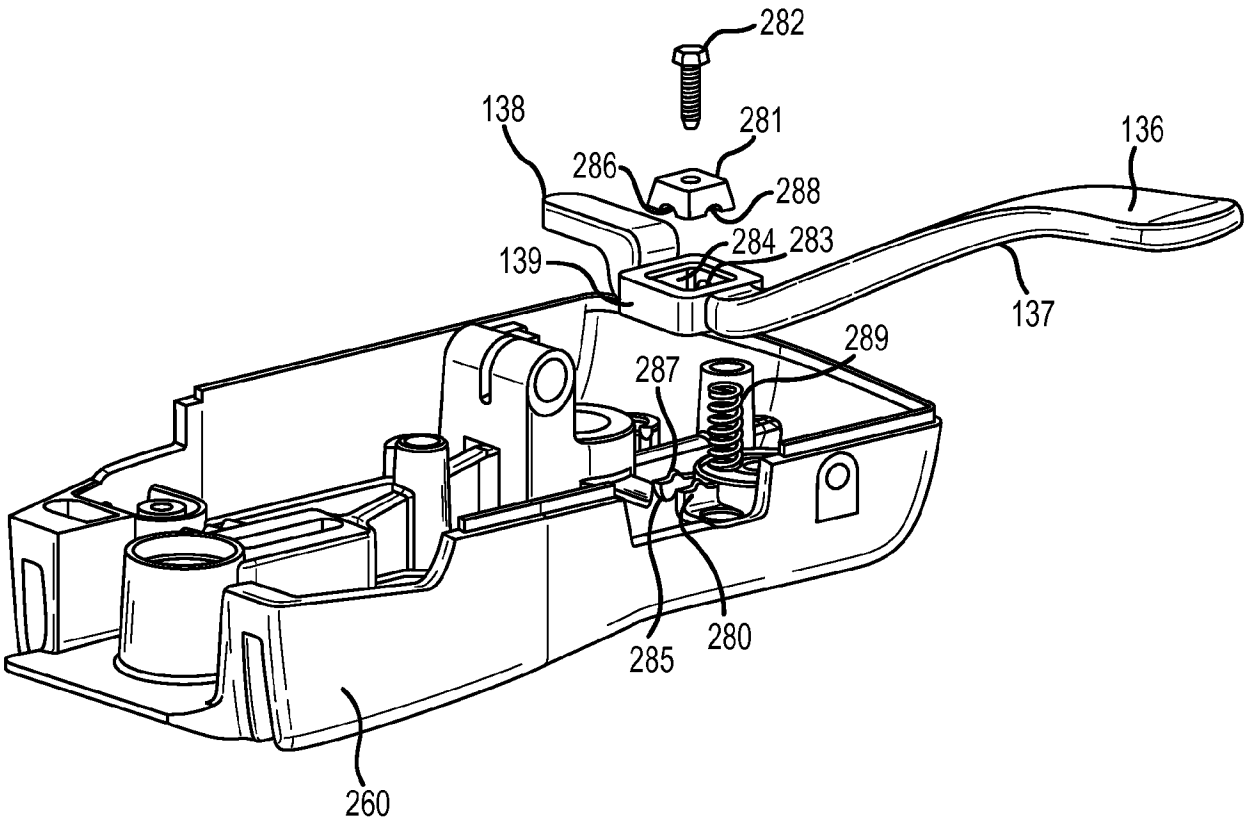
FIG. 27 is a partial exploded view of the control body including the height adjustment lever assembly.
Figure 28:
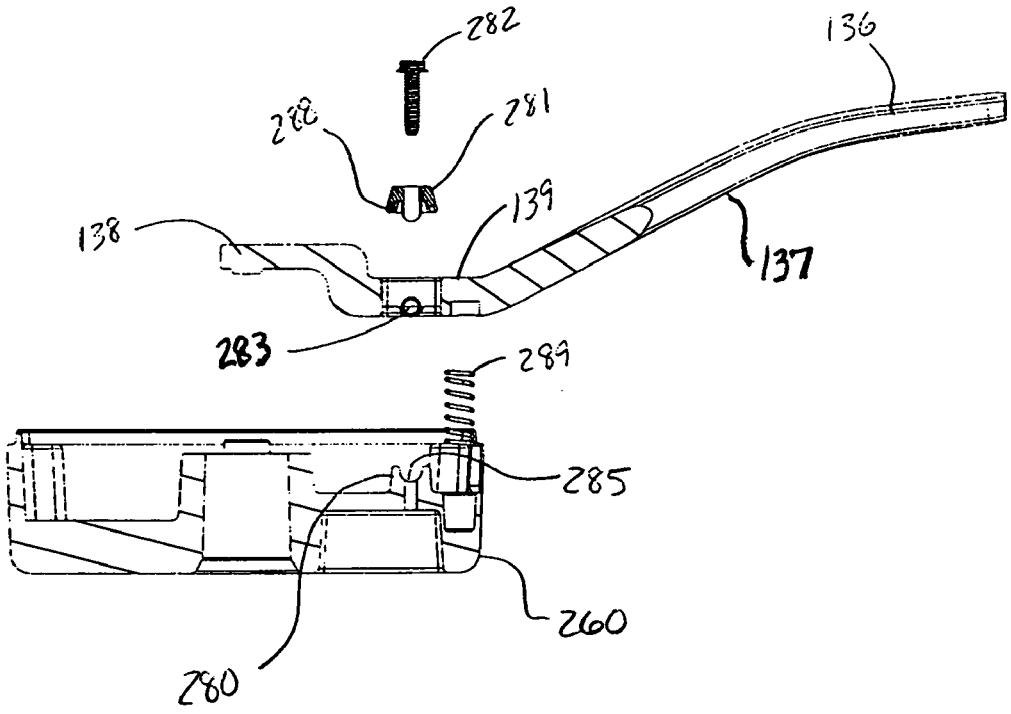
FIG. 28 is a partial rear view of the assembly of FIG. 27.
Figure 29:
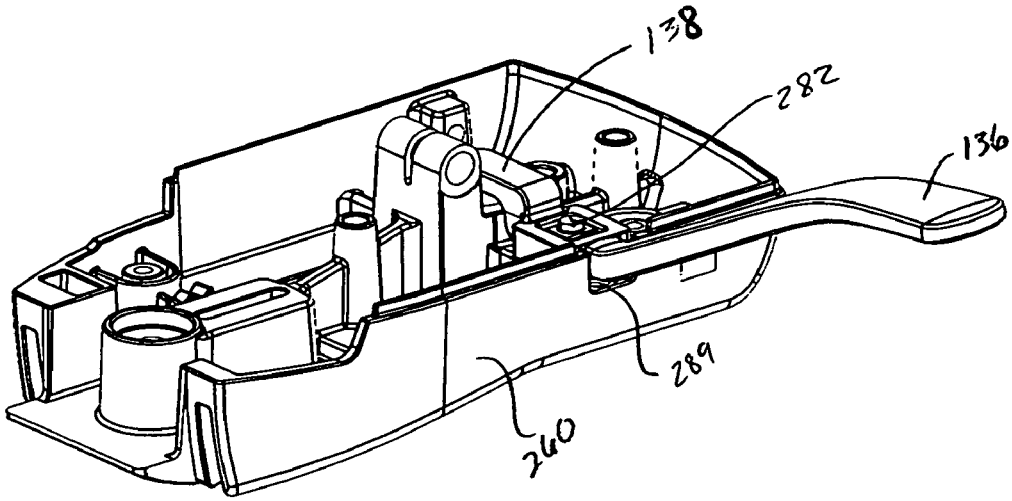
FIG. 29 is a view of the assembly of FIGS. 27 and 28 in an assembled condition.

While the function of the height adjustment lever 136 is similar to adjustments provided on other chairs, the pivotal mounting of the lever 136 is unique, improving and simplifying the assembly process. Referring now also to FIGS. 27-29, the lever 136 is pivotally mounted to the control body 260 at pivot mounting element 280 using a pivot block 281 and fastener 282. The lever 136 includes a handle 137, an activation portion 138 and a mounting portion 139. The mounting portion 139 is formed as an open square in which a pair of short posts or bosses 283 extend from opposite inner side walls 284 toward each other. The pivot mounting element 280 includes a semi-circular recess 285 configured to receive the pair of bosses 283. The pivot block 281 also includes a semi-circular recess 286 configured to also receive the pair of bosses 283. When the lever 136 is installed onto the control body 260, the pair of bosses 283 are sandwiched between the pivot mounting element 280 and the pivot block 281 in a manner that allows the bosses 283 to rotate within the recesses 285, 286. The pivot mounting element 280 also includes a pair of teeth 287 that are configured to mate with a pair of notches 288 on the pivot block 281 to simplify alignment and assembly of the parts. Alternatively, the bosses 283 may be provided on the exterior of the mounting portion 139, or the fastening method may be incorporated into the pivot block 281 to simplify the assembly process even further.

A spring 289 is provided and interposed between the control body 260 and the lever 136 so as to bias the lever in an un-activated position, keeping the activation portion 138 in contact with the cylinder and eliminating any vibration or rattling between the lever 136 and the cylinder. Activation of the lever 136, as described above, requires the user to pivot the lever 136, such that gravity returns the lever 136 to its un-activated position upon release of the lever 136 by the user.

As described, the pivotal mounting of lever 136 is accomplished with components that are all assembled on the same side of the control body 260, thus simplifying the assembly process. In the same manner, the two pivots on the seat locking lever 150 include similar components, such as pivot mounting elements 129 and pivot blocks 151, so as to simplify assembly of this pivoting lever as well. The design of this pivotal mounting structure may be utilized in many situations. The major advantages of this pivot joint assembly method and structure are that it is quick, easy and low cost to assemble, yet very effective in operation.

Referring again to FIGS. 1 and 4, the chairs 100 and 105 are shown with chair backs 110 and 115, respectively. In addition to the seat height, seat depth and tilt tension adjustability described above, the chairs 100, 105 of the present invention also include adjustable back support within the chair backs 110, 115. Referring now also to FIGS. 30-33, the mesh style chair back 110 of chair 100 is shown along with control mechanism 200. The frame 111 supports the tautly stretched mesh fabric 112. Although described with respect to mesh fabric, it is to be understood that other types of resilient material may also be used in place of the mesh, and all such variations are within the scope of the present invention.

In this embodiment, in order to provide adjustable back support for users of different sizes and needs, the present invention provides a tensioning device 160 that changes the stiffness of the mesh 112 across the back, in particular, such as in the lumbar region. This is different from other mesh back supports because they usually provide a solid brace or cushion or other additional member attached to the back 110 or frame 111 in the lumbar region, which causes discontinuities in the pressure gradient applied to the user's back.

The tensioning device 160 includes a pair of assemblies 161 mounted on either side of the frame 111. These assemblies 161 contain three components, a front piece 162, a rear piece 163 and a fastener 164. Although shown with three components, it is to be understood that the assemblies 161 may be formed with more or less components as desired to provide the same functionality. The assemblies 161 are affixed to a feature on the frame 111 that guides the motion of the assembly 161 as it travels vertically on the frame 111. The guide feature in this embodiment is a slot 165 that also limits the vertical travel of the assemblies 161. Alternatively, the guide feature could be a protrusion, and it could run the full height of the frame 111.

In this embodiment, the front piece 162 is configured with a generally convex front surface 166 and suitable structure to engage with the rear piece 163 and fastener 164. The rear piece 163 includes a pair of posts 167 configured to be positioned within the guide slot 165 and received within the rearward structure of the front piece 162. The rear piece 163 also includes a handle 168 that provides a grasping region for the user when adjusting the assemblies 161.

Figure 30:
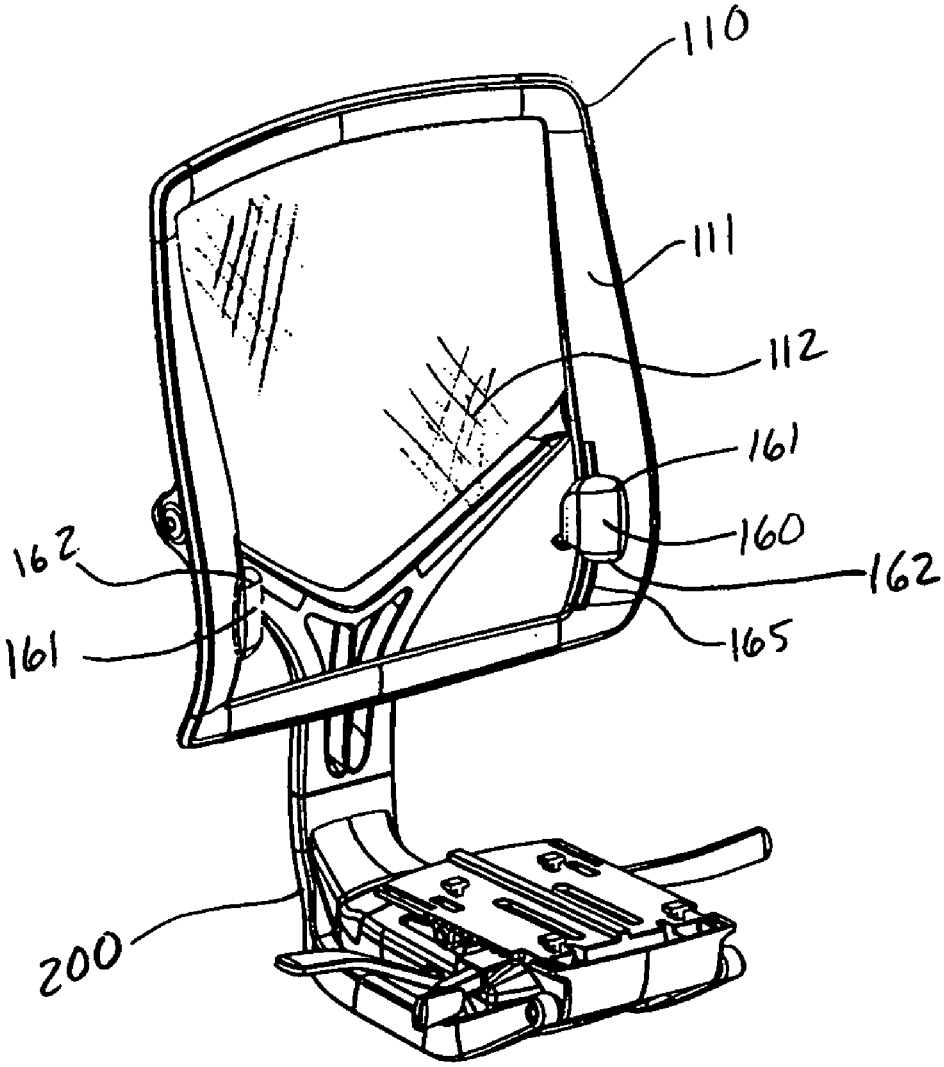
FIG. 30 is a partial view of the chair of FIG. 1, including the mesh back and control mechanism.
Figure 31:
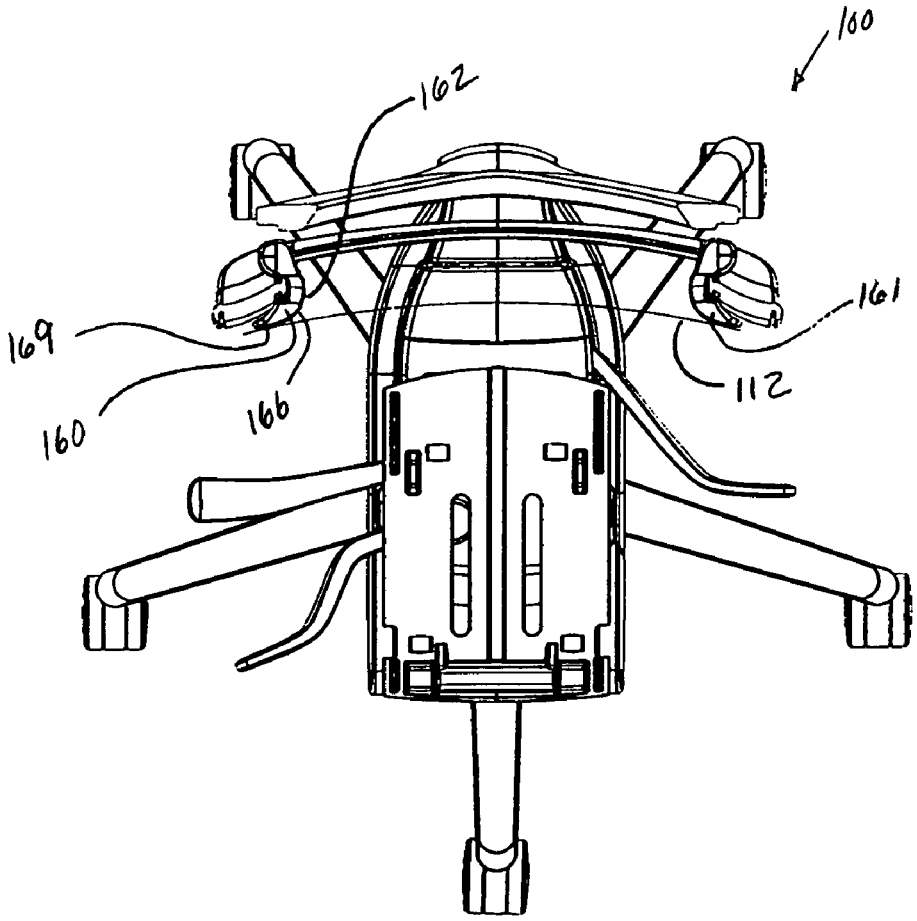
FIG. 31 is a partial top view of the chair of FIG. 1 without the seat.
Figure 32:
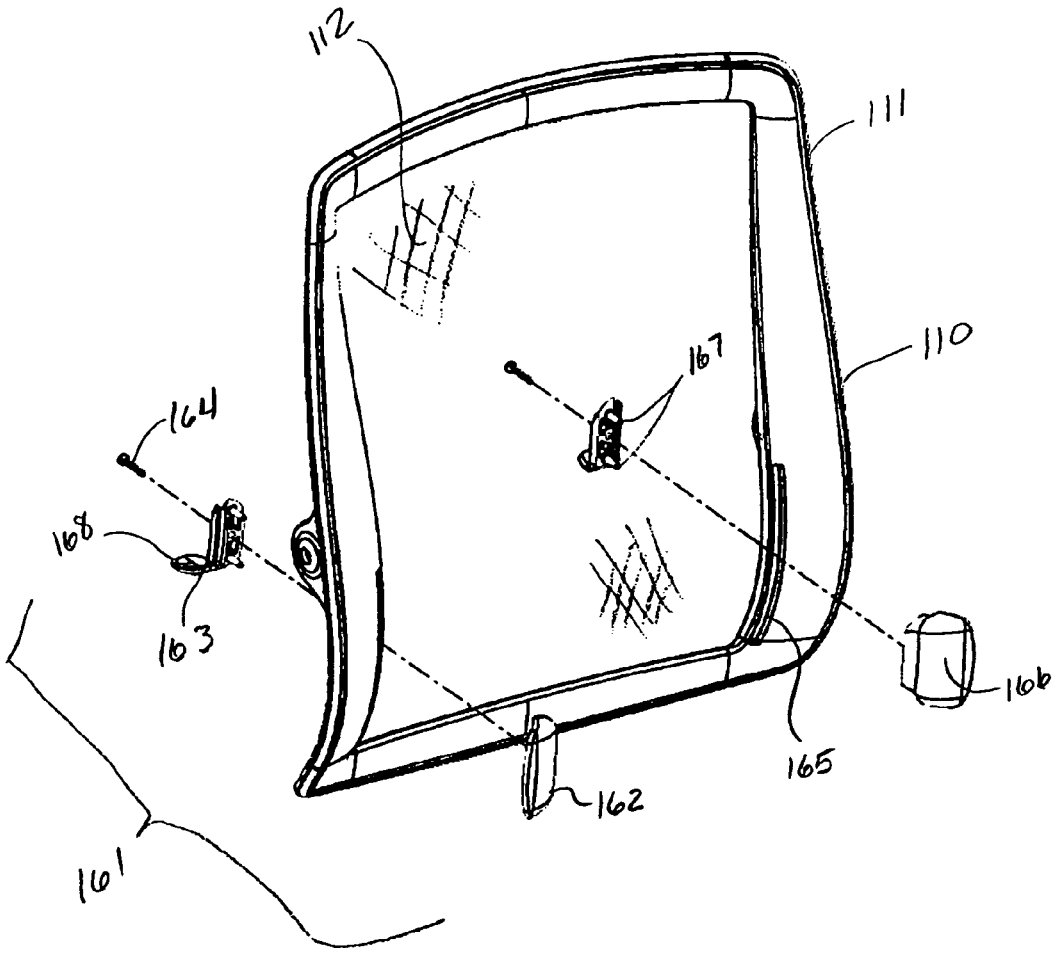
FIG. 32 is a partial exploded view of the mesh seat back of the chair of FIG. 1 showing the components of the lumbar support system.
Figure 33:
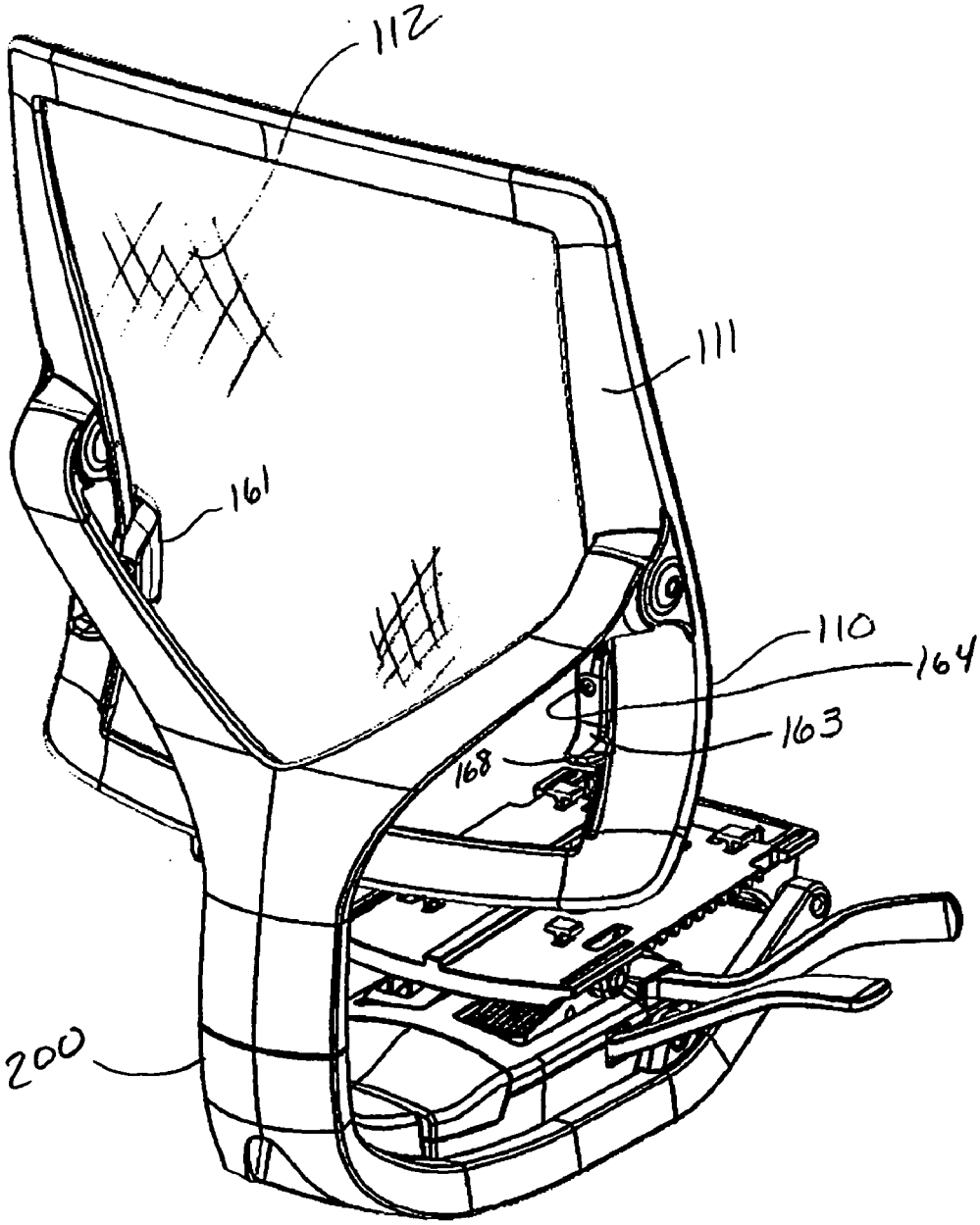
FIG. 33 is a partial rear view of the chair portion shown in FIG. 31.

The location of the assemblies 161 on the sides of the frame 111 provides improved adjustability and user comfort. As shown in FIG. 30, the furthest forward point of the assemblies 161 is the point of contact 169 with the mesh 112. This point of contact 166 is configured to be located outside of the contact region between the user's back and the mesh 112 at the perimeter of the frame 111. The furthest forward point 166 of the assemblies 161 shortens an effective length of the mesh 112 in the horizontal direction. Therefore, when the user contacts the mesh 112, this region does not have the same effective length over which to distribute the load applied by the user, causing a higher tension in the mesh 112 and a higher pressure on the user's back. Since the assemblies 161 do not span the width of the mesh 112, they will naturally distribute the tension change in the vertical direction, as well as the horizontal direction, resulting in a continuous tension gradient in the mesh 112 and, therefore, a continuous pressure gradient on the user's back. The high points of these gradients shift vertically as the assemblies 161 are moved vertically along the guide slots 165. Since the assemblies 161 are not connected to each other in any manner, they can be moved independently. Therefore, the high points of the gradients caused by each assembly 161 need not be at the same elevation.

Optionally, the high points 166 of the assemblies 161 could also be adjusted. This would allow the user to change the amount of tension seen in the mesh 112 and, therefore, the pressure on the user's back. This depth adjustment of the assemblies 161 would still cause continuous tension gradients throughout the mesh 112, adding another level of adjustment and customization.

Figure 34:
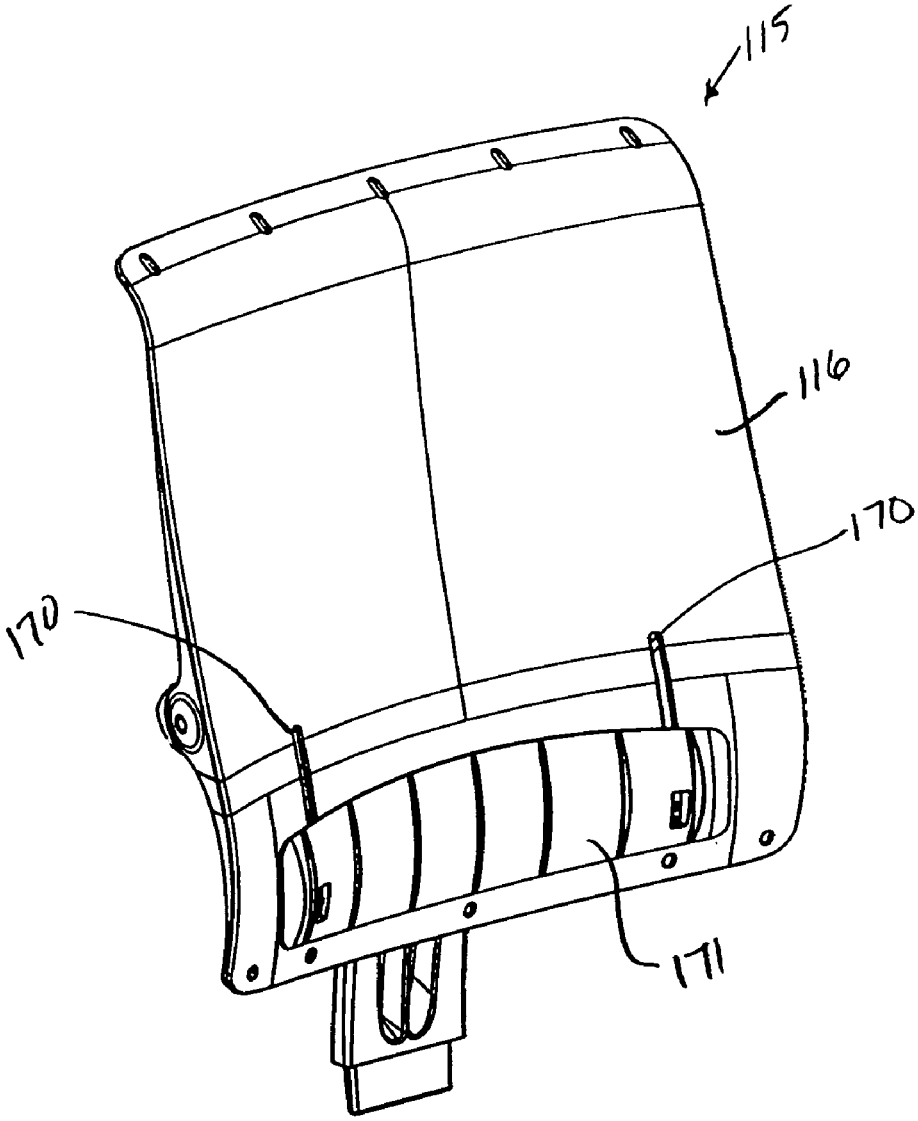
FIG. 34 is a partial view of the upholstered chair back of the chair in FIG. 4, shown with the fabric and foam pad removed.
Figure 35:
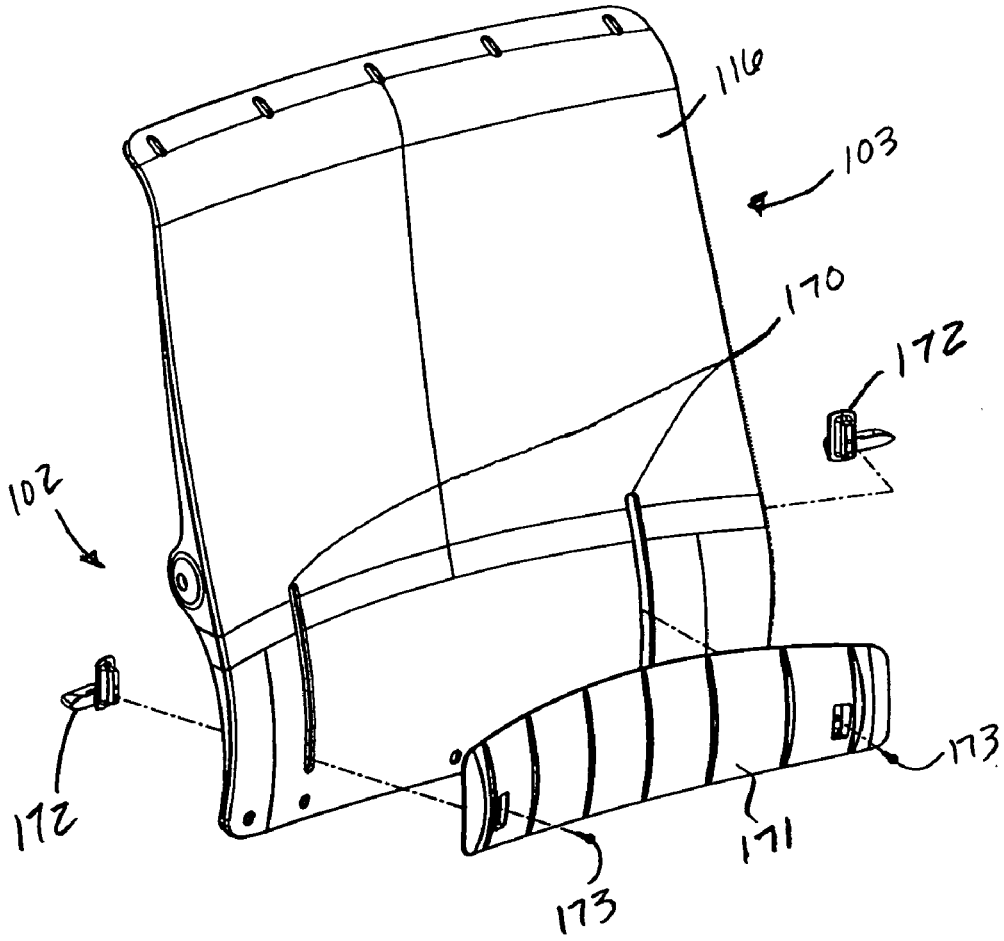
FIG. 35 is an exploded view of the chair back in FIG. 34, showing the components of the lumbar support system.
Figure 36:
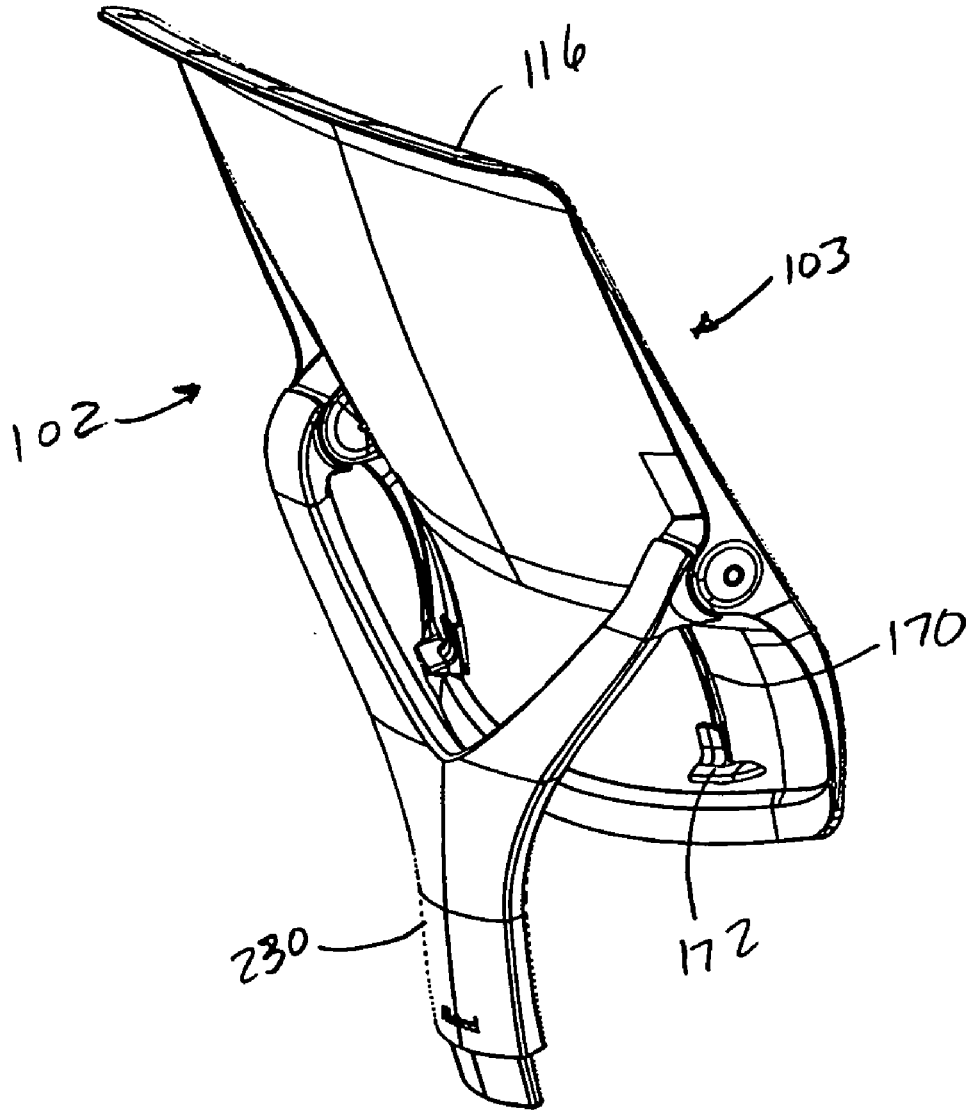
FIG. 36 is a rear view of the seat back of FIG. 34.

Referring now to FIGS. 34-36, back frame 116 of chair back 115 is shown with the fabric and foam pad 117 removed. In this embodiment, the back frame 116 includes a pair of vertical slots 170 to which a contoured support member 171 is moveably mounted. A pair of mounting handles 172 are positioned within the slots 170 from a back side 102 of the frame 116 and attached to the support member 171 by fasteners 173 or other suitable means. The support member 171 is held in position via the friction created by bracketing the slots 170 with the handles 172 and lumbar support member 171. The user must grab both handles 172 and overcome the friction force in order to adjust the support member 171 upwards or downwards. By using both handles 172 and the slots 170 for guides, the support member 171 will track in a generally straight direction. The fixed length of the slots 170 also acts as limit stops for the height adjustment range. The user's back does not rest directly on the support member 171. Rather, there is fabric and foam pad 117 (not shown) between the user and the support member 171 to provide padding and to help provide a smooth transition "feel" between the back and the lumbar region.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention. In addition, the embodiments and associated components described herein are to be taken to be cumulative, such that one or more of these components may be removed or mixed and matched in different combinations with the resulting configurations still within the scope of the present invention.

What is claimed is:

1. A reclining chair comprising:

a chair back comprising a back support element and a pivot member;

a seat;

a base having a central column with a central axis that is substantially vertical; and a control mechanism mounted on the base, the control mechanism coupling the chair back to the seat, the control mechanism configured as a four-bar mechanism including a ground member and the pivot member pivotally coupled to the ground member at a pivot point forward of the central axis, the pivot member pivotally attached to the back support element at a back pivot, such that a reclining force applied by the user to the chair back results in the chair back moving rearward and the seat lifting, pivoting the pivot member relative to the ground member about the pivot point and the back support element about the back pivot, wherein the seat functions as a coupler connected to the pivot member within the four-bar mechanism and wherein the control mechanism further comprises a follower connected to the seat and to the ground member, such that pivoting movement of the pivot member results in movement of the seat relative to the ground member, and wherein the seat comprises a seat assembly including a seat plate and a seat cushion moveably mounted to the seat plate, the seat plate coupled to the pivot member and the ground member.

2. The chair of claim 1, wherein the seat assembly further comprises a seat adjustment mechanism mounted between the seat cushion and the seat plate, such that operation of the seat adjustment mechanism results in movement of the seat cushion relative to the seat plate.

3. A reclining chair comprising:

a chair back comprising a back support element and a pivot member;

a seat;

a base having a central column with a central axis that is substantially vertical; and a control mechanism mounted on the base, the control mechanism coupling the chair back to the seat, the control mechanism configured as a four-bar mechanism including a ground member and the pivot member pivotally coupled to the ground member at a pivot point forward of the central axis, the pivot member pivotally attached to the back support element at a back pivot, such that a reclining force applied by the user to the chair back results in the chair back moving rearward and the seat lifting, pivoting the pivot member relative to the ground member about the pivot point and the back support element about the back pivot, wherein the control mechanism further comprises a tilt lock interacting with the ground member and the pivot member, the tilt lock moveable between an unlocked position and a locked position, wherein the tilt lock in its locked position substantially prevents reclining of the chair back from an upright position.

4. A reclining chair comprising:

a chair back comprising a back support element and a pivot member;

a seat;

a base having a central column with a central axis that is substantially vertical; and a control mechanism mounted on the base, the control mechanism coupling the chair back to the seat, the control mechanism configured as a four-bar mechanism including a ground member and the pivot member pivotally coupled to the ground member at a pivot point forward of the central axis, the pivot member pivotally attached to the back support element at a back pivot, such that a reclining force applied by the user to the chair back results in the chair back moving rearward and the seat lifting, pivoting the pivot member relative to the ground member about the pivot point and the back support element about the back pivot, wherein the chair back further comprises a back support adjustment mechanism, the back support adjustment mechanism configured to modify a stiffness of the back support element.

5. The chair of claim 4, wherein the chair back further comprises a frame and a resilient material mounted on the frame, and wherein the back support adjustment mechanism modifies a stiffness of the resilient material.

6. The chair of claim 4, wherein the back support adjustment mechanism modifies the stiffness in a lumbar region of the chair back.

7. A reclining chair comprising:

a chair back comprising a back support element and a pivot member;

a seat;

a base having a central column with a central axis that is substantially vertical; and a control mechanism mounted on the base, the control mechanism coupling the chair back to the seat, the control mechanism configured as a four-bar mechanism including a ground member and the pivot member pivotally coupled to the ground member at a pivot point forward of the central axis, the pivot member pivotally attached to the back support element at a back pivot, such that a reclining force applied by the user to the chair back results in the chair back moving rearward and the seat lifting, pivoting the pivot member relative to the ground member about the pivot point and the back support element about the back pivot, wherein the control mechanism further comprises a resistance adjustment mechanism for varying the control mechanism's resistance to the reclining force applied by the user to the chair back, the resistance adjustment mechanism easily operated by the user when the chair is in an upright position, wherein the resistance adjustment mechanism comprises a first movable member and a second member, the second member generally fixed with respect to the first movable member in at least one direction, and wherein movement by the user of the first movable member relative to the second member changes the control mechanism's resistance to the reclining force, and wherein the resistance adjustment mechanism further comprises a resilient member having a varying resistance to compression, the resilient member coupled to the first movable member, and wherein movement of the resilient member changes the resistance to compression of the resilient member encountered by the second member, thereby changing the control mechanism's resistance to the reclining force.

8. A reclining chair comprising:

a chair back comprising a back support element and a pivot member;

a seat;

a base having a central column with a central axis that is substantially vertical; and a control mechanism mounted on the base, the control mechanism coupling the chair back to the seat, the control mechanism configured as a four-bar mechanism including a ground member and the pivot member pivotally coupled to the ground member at a pivot point forward of the central axis, the pivot member pivotally attached to the back support element at a back pivot, such that a reclining force applied by the user to the chair back results in the chair back moving rearward and the seat lifting, pivoting the pivot member relative to the ground member about the pivot point and the back support element about the back pivot, and wherein the chair back further comprises a back support adjustment mechanism, the back support adjustment mechanism configured to modify a stiffness of the chair back.

9. The chair of claim 8, wherein the chair back further comprises a frame and a resilient material mounted on the frame, and wherein the back support adjustment mechanism modifies a stiffness of the resilient material.

10. The chair of claim 8, wherein the back support adjustment mechanism modifies the stiffness in a lumbar region of the chair back.

* * * * *